US008135160B2

(12) United States Patent
Mitobe et al.

(10) Patent No.: US 8,135,160 B2
(45) Date of Patent: Mar. 13, 2012

(54) SPEAKER DEVICE AND MOBILE PHONE

(75) Inventors: Kunio Mitobe, Yamagata (JP); Akihiko Furuto, Yamagata (JP)

(73) Assignees: Pioneer Corporation, Tokyo (JP); Tokoku Pioneer Corporation, Tendo-Shi, Yamagata (JP)

( * ) Notice: Subject to any disclaimer, the term of this patent is extended or adjusted under 35 U.S.C. 154(b) by 1308 days.

(21) Appl. No.: 11/642,962

(22) Filed: Dec. 21, 2006

(65) Prior Publication Data

US 2007/0147651 A1 Jun. 28, 2007

(30) Foreign Application Priority Data

Dec. 21, 2005 (JP) ..... 2005-368531

(51) Int. Cl.
*H04R 1/00* (2006.01)
*H04R 25/00* (2006.01)
*H04R 7/00* (2006.01)

(52) U.S. Cl. ..... 381/396; 381/177; 381/412; 381/409; 381/423; 181/171

(58) Field of Classification Search ..... 381/400, 381/401, 405, 407, 412, 414; 181/171
See application file for complete search history.

(56) References Cited

U.S. PATENT DOCUMENTS 5,157,731 A 10/1992 Mitobe
5,892,185 A 4/1999 Takahashi et al.
6,154,556 A 11/2000 Takahashi et al.
6,973,194 B2 * 12/2005 Iwasa et al. ..... 381/412
2003/0164262 A1 * 9/2003 Ito et al. ..... 181/171
2004/0086150 A1 5/2004 Stiles
2005/0041830 A1 * 2/2005 Takewa et al. ..... 381/410
2007/0140520 A1 6/2007 Konuma et al.
2007/0147651 A1 6/2007 Mitobe et al.

FOREIGN PATENT DOCUMENTS

JP S55-144489 10/1980
JP 57-021200 2/1982

(Continued)

OTHER PUBLICATIONS

"New Edition Encyclopedia of Speakers and Enclosures", Tamon Saeki, Seibundo-Shinkosha, Aug. 1, 2002, vol. 3, p. 40 and its English partial translation.

(Continued)

*Primary Examiner* — Curtis Kuntz
*Assistant Examiner* — Sunita Joshi
(74) *Attorney, Agent, or Firm* — Nixon & Vanderhye P.C.

(57) ABSTRACT

A speaker device includes: a magnetic circuit which includes two magnetic gaps; a diaphragm which is arranged at a position passing through at least the two magnetic gaps and includes a recessed part extending in a direction substantially orthogonal with respect to an extending direction of a magnetic flux in the magnetic gaps; and a voice coil, formed into an annular shape, which includes a first parallel part extending in one direction and a second parallel part extending in a direction in parallel with the first parallel part and opposite to the first parallel part with a constant space. Particularly, the first parallel part and the second parallel part are arranged in a direction in parallel with an extending direction of the recessed part, respectively, and the first parallel part and the second parallel part are arranged in the recessed part to be positioned in the two magnetic gaps, respectively.

21 Claims, 13 Drawing Sheets

FOREIGN PATENT DOCUMENTS

| | | |
|---|---|---|
| JP | S59-189398 | 12/1984 |
| JP | 5-30592 | 2/1993 |
| JP | H06-070399 | 9/1994 |
| JP | 10-191494 | 7/1998 |
| JP | H10-191494 | 7/1998 |
| JP | H11-146487 | 5/1999 |
| JP | 11-187484 | 7/1999 |
| JP | 11-187485 | 7/1999 |
| JP | H11-187484 | 7/1999 |
| JP | 2000-350284 | 12/2000 |
| JP | 2002-176692 | 6/2002 |
| JP | 2002-176693 | 6/2002 |
| JP | 3334842 | 10/2002 |
| JP | 3337631 | 10/2002 |
| JP | 2003-032789 | 1/2003 |

OTHER PUBLICATIONS

U.S. Appl. No. 11/641,116, Shinsuke Konuma et al.; filed Dec. 19, 2006.

U.S. Appl. No. 11/641,116, Official Action issued Nov. 24, 2010.

U.S. Appl. No. 11/642,964, Kunio Mitobe et al.; filed Dec. 21, 2006.

U.S. Appl. No. 11/642,964, Official Action issued Jan. 18, 2011.

"New Edition Encyclopedia of Speakers and Enclosures", Tamon Saeki, Seibundo-Shinkosha, Aug. 1, 2002, vol. 3, p. 40 and its English partial translation.

* cited by examiner

SPEAKER DEVICE AND MOBILE PHONE

BACKGROUND OF THE INVENTION

1. Field of the Invention

The present invention relates to a configuration of a speaker device preferably usable for a mobile phone.

2. Description of Related Art

Conventionally, there is known a Ryffel-type speaker including a rectangular diaphragm and a liner voice coil arranged at a central part of the diaphragm (see "New Edition Encyclopedia of Speakers and enclosures" Tamon Saeki, Seibundo-Shinkosha, Aug. 1, 2002, Vol. 3, P. 40, for example). The speaker having a configuration of this kind is disclosed in Japanese Patent Applications Laid-open under No. 11-187484 and No. 10-191494, which are referred to as References-1 and 2, respectively.

The speaker according to Reference-1 mainly includes two diaphragms and a magnetic circuit including two, i.e., upper and lower magnetic gaps in parallel with each other and having opposite magnetic flux directions. At substantial centers on rear surfaces of the respective diaphragms, two, i.e., upper and lower voice coils are arranged, respectively. Thereby, it is said that, even with an elongated configuration having narrow opening diameter and horizontal width, a minimum resonance frequency f0 can be low, and withstand input and a characteristic between low frequency reproduction and a sound pressure frequency can be improved.

The speaker according to Reference-2 mainly includes a rectangular diaphragm, a plate-shaped driving force transmission member connected with the diaphragm and inserted to the magnetic gap of the magnetic circuit, a damper formed into a substantially "S" shape, and a voice coil connected with a driving force transmission member. Thereby, suppression of displacement difference in an up-and-down direction, reduction of non-linear distortion at large magnitude and low frequency reproduction can be realized. The speaker includes one or two magnetic gap(s) in which the voice coil is arranged.

Supporting methods of the voice coil at a predetermined position of the diaphragm in the speaker are disclosed in Japanese Patent Publications No. 3337631 and No. 3334842, which are referred to as References-3 and 4, respectively.

The speaker according to Reference-3 includes a recessed part having a U-shaped cross-section at an outer peripheral edge portion of the diaphragm in a ring state, an edge damper at an outer peripheral edge portion of the recessed part, and a cylindrical voice coil attached to the inside of the recessed part by an adhesive. The voice coil is arranged in the magnetic gap of the magnetic circuit together with the recessed part and supported in a floating manner by the edge damper. Additionally, in the speaker according to Reference-4 the diaphragm has the voice coil arranged on an outer circumferential surface of a short cylindrical part provided at an end edge part of a main part formed into a semi-sphere shape.

However, the speaker device according to the above-mentioned References-1 and 2 structurally becomes thick in the vibration direction of the diaphragm, and there is such a problem that the speaker device is hardly applied to a recent mobile phone of a thin-type.

SUMMARY OF THE INVENTION

The present invention has been achieved in order to solve the above problem. It is an object of this invention to provide a speaker device capable of obtaining high sensitivity, high efficiency and low frequency sound and able to be thin and slim.

According to one aspect of the present invention, there is provided a speaker device including: a magnetic circuit which includes two magnetic gaps; a diaphragm which is arranged at a position passing through at least the two magnetic gaps and includes a recessed part extending in a direction substantially orthogonal with respect to an extending direction of a magnetic flux in the magnetic gaps; and a voice coil which includes a first parallel part extending in one direction and a second parallel part extending in a direction in parallel with the first parallel part and opposite to the first parallel part with a constant space, wherein the first parallel part and the second parallel part are arranged in a direction in parallel with an extending direction of the recessed part, respectively, and wherein the entire first parallel part and the entire or part of the second parallel part are arranged in the recessed part to be positioned in the two magnetic gaps, respectively.

The speaker device includes: the magnetic circuit which includes the two magnetic gaps; the diaphragm which is arranged at the position passing through at least the two magnetic gaps and includes the recessed part extending in the direction substantially orthogonal with respect to the extending direction of the magnetic flux (magnetic force) in the magnetic gaps; and the voice coil which includes the first parallel part extending in the one direction and the second parallel part extending in the direction in parallel with the first parallel part and opposite to the first parallel part with the constant space. In a preferred example, the voice coil may be formed into an elongated circular plane shape, and the second parallel part may be positioned above the first parallel part. Preferably, a direction of a sound current flowing in the first parallel part and a direction of the sound current flowing in the second parallel part may be opposite directions. Thereby, the first parallel part and the second parallel part can be vibrated with the driving force of the same amount in the same direction.

Particularly, in the speaker device, the first parallel part and the second parallel part are arranged in the direction in parallel with the extending direction of the recessed part, respectively, and the entire first parallel part and the entire or part of the second parallel part are arranged in the recessed part to be arranged in the two magnetic gaps, respectively. Thereby, the speaker device employs 2-magnetic-gap and 2-voice-coil system. Thus, as compared with a speaker device (1-magnetic-gap and 1-voice-coil system) structurally including one magnetic gap having a voice coil, the speaker device of this kind can increase the driving force of the voice coil at the time of sound reproduction, and the high sensitivity and high efficiency of the speaker device can be realized.

Therefore, the speaker device according to the present invention can be preferably used as the speaker device for a call-indicating part of a mobile phone for which the high sensitivity is necessary or as the speaker device loaded on various kinds of electronic equipments for mobile or for neighboring acoustic field.

In addition to this, since the speaker device does not include a normally used voice coil bobbin, it can be light by the amount. That is, the number of components of the speaker device can be reduced, and the high sensitivity and the high efficiency can be realized. Moreover, the manufacturing cost can be lower.

Further, in the speaker device, when such a configuration that the entire first parallel part and the part of the second parallel part are arranged in the recessed part of the diaphragm is employed, the depth of the recessed part of the diaphragm can be shallow to some extent at the time of manufacturing, and the form of the diaphragm can be improved. Namely, by this configuration, at the time of forming the diaphragm, by holding the half of the recessed part of the diaphragm at which the second parallel part is arranged and making a taper of the other half thereof large and wide, the outer part of the recessed part can be formed. Thus, the formation of the diaphragm can be improved.

In addition, since the recessed part of the diaphragm is arranged at the position passing through at least two magnetic gaps, the distance from the rear surface of the magnetic circuit to the upper surface (sound output surface) of the diaphragm can be small, and the height of the speaker device, corresponding to the vibration direction of the diaphragm and the voice coil, can be small. Thus, since the thin speaker device can be formed, the speaker device can be preferably used for the mobile phone or for the various kinds of electronic equipments for the mobile or for the neighboring acoustic field, recently becoming thinner.

In a manner of the above speaker device, each of the two magnetic gaps may be formed at a substantially central position of the magnetic circuit, respectively. The diaphragm may be formed into an elongated circular or ellipse plane shape, and the recessed part of the diaphragm may be formed into an elongated shape and a U-shaped cross-section and arranged at a substantially central position of the diaphragm.

In this manner, each of the two magnetic gaps is formed at the substantially central position of the magnetic circuit, respectively, and the diaphragm is formed into the elongated circular or ellipse plane shape, and the recessed part of the diaphragm is formed into the elongated shape and the U-shaped cross-section and arranged at the substantially central position of the diaphragm. Thereby, the speaker device can be slim (i.e., the width can be narrow).

In another manner of the above speaker device, the first parallel part and the entire or part of the second parallel part may be sandwiched and fixed by side surfaces of the recessed part. Thereby, the voice coil is stably retained by the recessed part, and such a disadvantage that the voice coil is easily bent in the vibration direction thereof can be overcome. Namely, thereby, the voice coil is hardly bent in the vibration direction thereof. Hence, it becomes possible to appropriately position the first parallel part in one of the two magnetic gaps and the second parallel part in the other magnetic gap, respectively.

In another manner of the above speaker device, the magnetic circuit may include a yoke arranged at a substantially central position of the magnetic circuit and including an opening formed longer than a length in an extending direction of the recessed part; a pair of magnets, formed into a rectangular parallelepiped shape and oppositely mounted on an upper surface of the yoke with a constant space, the positional relation of an S-pole and an N-pole of one of the pair of the magnets being reverse to the positional relation of the S-pole and the N-pole of the other one of the pair of the magnets with respect to a vibration direction of the diaphragm; and a pair of plates having a rectangular parallelepiped or flat-plate shape and oppositely mounted on an upper surface of each of the pair of magnets. The magnetic gap may be formed in the opening and the other magnetic gap may be formed between the pair of plates. The first parallel part may be positioned in the magnetic gap, and the entire or part of the second parallel part may be positioned in the other magnetic gap.

Thereby, the high sensitivity and the high efficiency of the speaker device can be realized, the height and the width direction of the speaker device corresponding to the vibration direction of the voice coil and the diaphragm can be small. Thus, the speaker device can be thin and slim.

In another manner of the above speaker device, the magnets may be mounted on upper surfaces of the pair of plates, and the positional relation of an S-pole and an N-pole of one of the pair of the magnets may be reverse to the positional relation of the S-pole and the N-pole of the other one of the pair of the magnets with respect to a vibration direction of the diaphragm.

In this manner, the magnets are mounted on the upper surfaces of the pair of plates. The positional relation of an S-pole and an N-pole of one of the pair of the magnets is reverse to the positional relation of the S-pole and the N-pole of the other one of the pair of the magnets with respect to the vibration direction of the diaphragm. The other magnet is generally referred to as "reacting magnet", because it is arranged at a position reacting to the magnet.

In this manner, since the speaker device further includes the other magnet serving as the reacting magnet in addition to the pair of magnets, the magnitude of the magnetic force in the magnetic field in the magnetic gap can be large by the amount. Thereby, the sensitivity and the efficiency can be increased.

In still another manner of the above speaker device, the magnetic circuit may include a yoke arranged at a substantially central position of the magnetic circuit and having an opening formed longer than a length in an extending direction of the recessed part, a magnet having a rectangular parallelepiped shape and mounted on an upper surface of the yoke, a magnetic body oppositely mounted on the upper surface of the yoke with a constant space to the magnet, and a plate having a rectangular parallelepiped or flat-plate shape and mounted on an upper surface of the magnet; the magnetic gap may be formed in the opening, and the other magnetic gap may be formed between the magnet and the magnetic body; and the first parallel part may be positioned in the magnetic gap, and the entire or part of the second parallel part may be positioned in the other magnetic gap.

Therefore, there are operation and effect described below. Namely, when the numbers of magnets and plates become small, the sensitivity is reduced by the amount. However, according to the specification of the electronic equipments such as the mobile phone to which the speaker device is applied, the high sensitivity and efficiency are not always necessary. For example, as the speaker device used for the mobile phone, there are two kinds, i.e., for the receiver part and for the call-indicating part. In the case of the speaker device for the receiver part, though the priorities of the miniaturization and lowering the minimum resonance frequency f0 (low f0) are high as a specification, the high sensitivity and efficiency are not so necessary. Thus, in the case, in consideration of the manufacturing cost, it is preferable that the speaker device in this manner is applied as the receiver of the mobile phone. Namely, as the preferred speaker device for the mobile phone for which the high sensitivity and efficiency are not so necessary, it is preferable to apply the speaker device in this manner whose sensitivity and efficiency are slightly inferior to those of the above-mentioned speaker device by the amount of insufficiently setting number of magnets, but whose manufacturing cost is lower than that of the above-mentioned speaker device by the amount of inferiority.

In another manner of the above speaker device, the magnetic circuit may include a yoke arranged at a substantially central position of the magnetic circuit and having an opening formed longer than a length in an extending direction of the recessed part, a pair of magnetic bodies oppositely mounted on an upper surface of the yoke with a constant space, and a pair of magnets, the positional relation of an S-pole and an N-pole of one of the pair of the magnets being reverse to the positional relation of the S-pole and the N-pole of the other one of the pair of the magnets with respect to an extending direction of the magnetic flux; the magnetic gap may be formed in the opening and the other magnetic gap may be formed between the pair of magnetic bodies; one of the pair of magnets may be mounted on a side wall of the opening to be positioned in the magnetic gap, and the other magnet may be arranged oppositely to the magnet with a constant space in a vibration direction of the diaphragm and mounted on one of the pair of magnetic bodies to be positioned in the other magnetic gap; and the first parallel part may be positioned in the magnetic gap, and the entire or part of the second parallel part may be positioned in the other magnetic gap.

In this manner, one of the magnets is directly positioned in the magnetic gap, and the other magnet is directly positioned in the other magnetic gap. Therefore, in order to realize this, it is necessary that the size of the two magnets is made small, respectively. Thereby, the speaker device can be light, and magnetic efficiency can be improved. "Magnetic efficiency" is magnitude of the magnetism generated per gram of the magnet.

In another manner of the above speaker device, the magnetic circuit may include a yoke arranged at a substantially central position of the magnetic circuit and having an opening formed longer than a length in an extending direction of the recessed part, a pair of magnetic bodies oppositely mounted on an upper surface of the yoke with a constant space, and a magnet; the magnetic gap may be formed in the opening and the other magnetic gap may be formed between the pair of magnetic bodies; the magnet may be mounted on one of the pair of magnetic bodies to be positioned in the other magnetic gap; and the first parallel part may be positioned in the magnetic gap, and the entire or part of the second parallel part may be positioned in the other magnetic gap.

Thereby, as compared with the above speaker device, the speaker device can be further lighter. As compared with the speaker device directly including two magnets in two magnetic gaps, respectively, though the magnetic efficiency of the speaker device is slightly inferior, it can be enhanced to some extent.

In another manner of the above speaker device, the magnetic circuit may include a yoke arranged at a substantially central position of the magnetic circuit and having an opening formed longer than a length in an extending direction of the recessed part, a pair of plates having a rectangular parallelepiped or flat-plate shape and oppositely mounted on an upper surface of the yoke, and a pair of magnets, having a rectangular parallelepiped shape and oppositely mounted on an upper surface of each of the pair of plates with a constant space, the positional relation of an S-pole and an N-pole of one of the pair of the magnets being reverse to the positional relation of the S-pole and the N-pole of the other one of the pair of the magnets with respect to a vibration direction of the diaphragm, and an additional pair of plates having a rectangular parallelepiped or flat-plate shape and oppositely mounted on an upper surface of each of the pair of magnets; the magnetic gap may be formed between the pair of plates, and the other magnetic gap may be formed between the additional pair of plates; and the first parallel part may be positioned in the magnetic gap, and the entire or part of the second parallel part may be positioned in the other magnetic gap.

Thereby, the configuration in the magnetic circuit can be symmetrical with respect to the central axis of the speaker device, and the magnitude of the magnetic force generated in the magnetic gap and the magnitude of the magnetic force generated in the other magnetic gap can be further equalized.

In still another manner, the above speaker device may further include a frame having a cylindrical or annular plane shape and housing the magnetic circuit, wherein a step part in a step state is formed at an outer peripheral portion on an upper surface of the frame, wherein the diaphragm includes a sound output part provided around the recessed part, having a hemisphere cross-section and having a function to output an acoustic wave, and a step part provided at an outer peripheral portion of the sound output part and formed into a step shape, and wherein the step part of the diaphragm becomes engaged with the step part of the frame, and the recessed part is arranged at a substantially central position of the frame.

Thereby, the voice coil can be arranged at the substantially central position of the speaker device, i.e., at the substantially central position of the frame, and the relative positional relation between the voice coil and the diaphragm can be set to an appropriate state. In addition, the diaphragm can be smoothly and stably moved at the time of the sound reproduction. Thus, the strength of the entire vibration system including the voice coil and the diaphragm can be sufficiently ensured.

In still another manner of the above speaker device, the sound output part may have a function of an edge, and a length in a lateral direction of the sound output part may occupy a major of a length in a lateral direction of the diaphragm.

Generally, when the edge width becomes large, the edge correspondently becomes soft. The resonance frequency of the speaker device can be lowered, and the voice coil can be close to the central position of the speaker device. There by, the minimum resonance frequency f0 can be lowered, and the low frequency can be easily obtained. In this point, in this manner, the sound output part has the function of the edge for absorbing the unnecessary vibration at the time of the sound reproduction, and the length in the lateral direction of the sound output part occupies the major part of the length in the lateral direction of the diaphragm, the edge width inevitably becomes large. Therefore, the minimum resonance frequency f0 can be lowered, and the low frequency sound output can be easily obtained. As a result, it becomes possible that the speaker device having the diaphragm obtains the high sensitivity to be preferably used as the speaker for the mobile phone.

In another embodiment of the present invention, the mobile phone including the above speaker device may be formed. Thereby, the speaker device with high sensitivity and high efficiency can be obtained.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

Now, preferred embodiments of the present invention will be described below with reference to the attached drawings. The speaker device according to various kinds of embodiments of the present invention is a thin and slim type (narrow width type) speaker device capable of obtaining the high sensitivity, the high efficiency and the low frequency sound, and preferably usable for the receiver part or for the call-indicating part of the mobile phone, or for various kinds of electronic equipments for the mobile or for the neighboring acoustic field.

First Embodiment

Configuration of Speaker Device

Figure 1A:
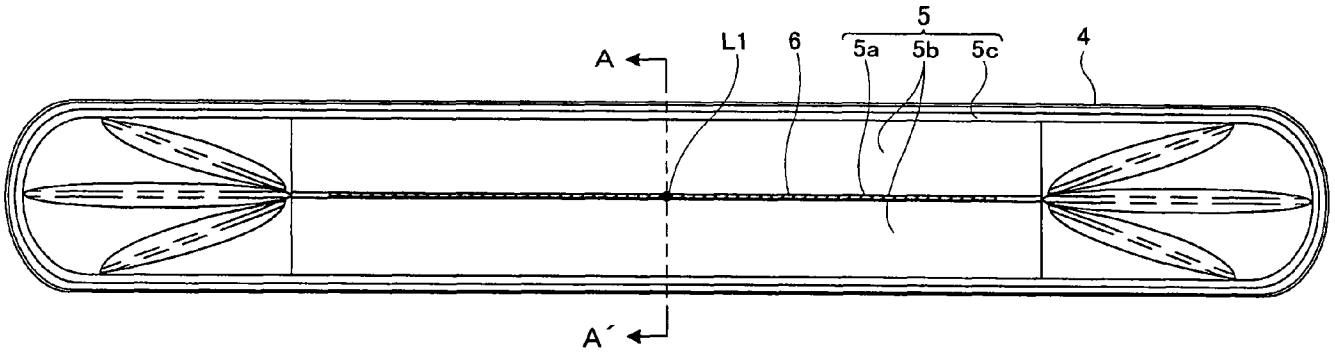
FIGS. 1A and 1B are a plane view and a side view showing a configuration of a speaker device according to a first embodiment of the present invention.
Figure 1B:
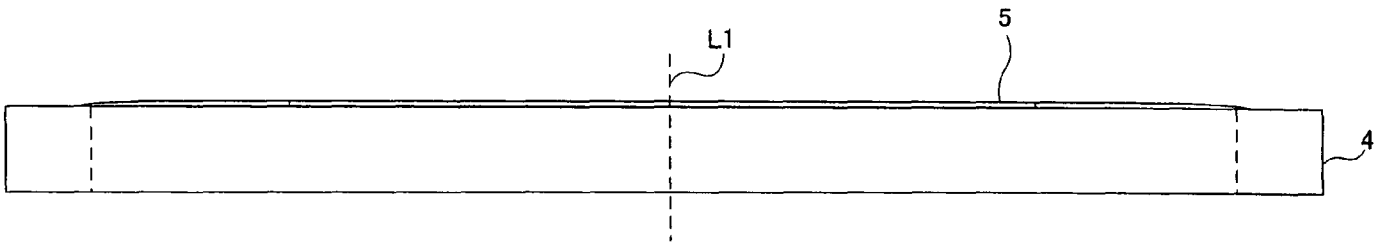
Figure 2:
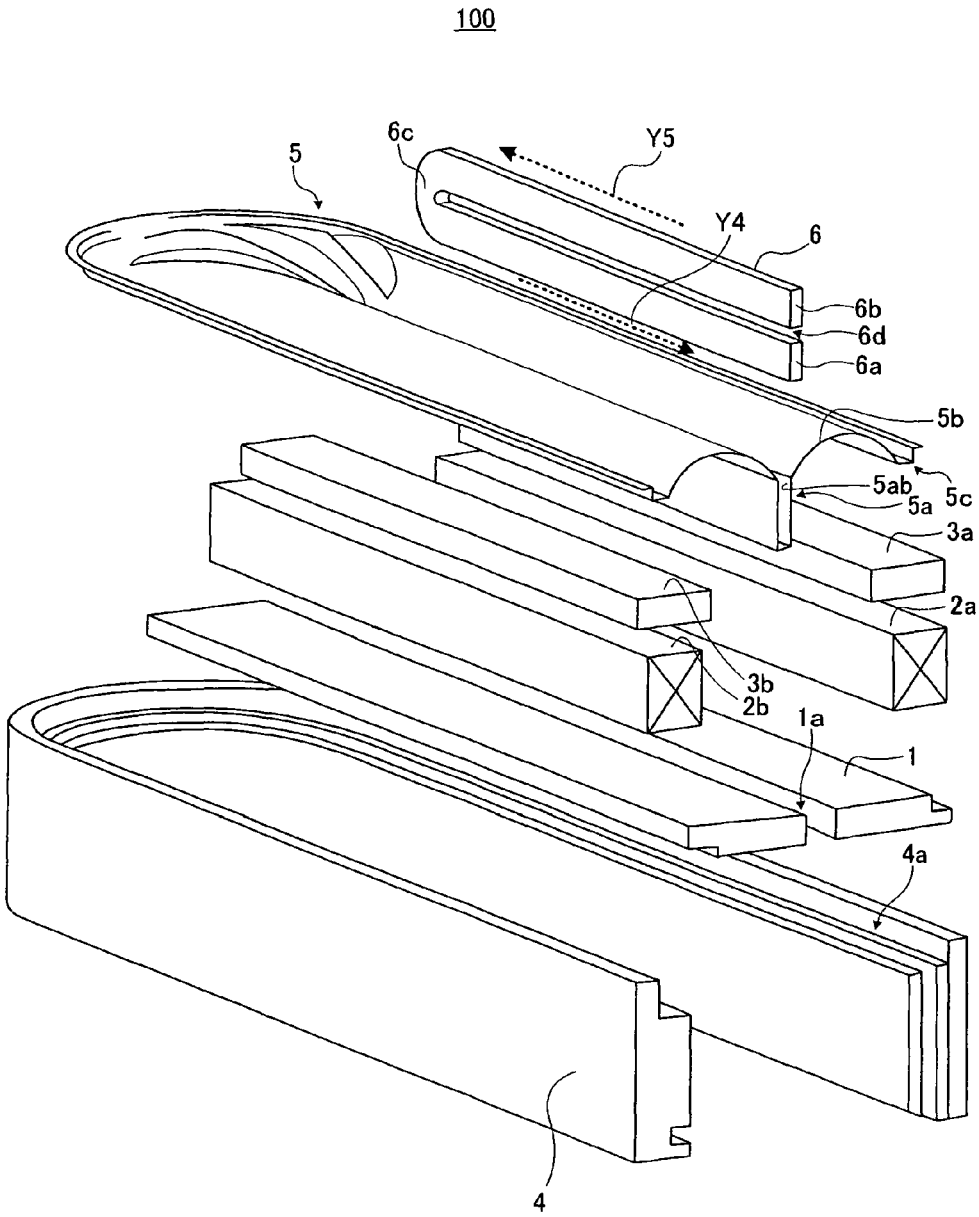
FIG. 2 is a side disassembly perspective view showing the configuration of the speaker device according to the first embodiment.
Figure 3:
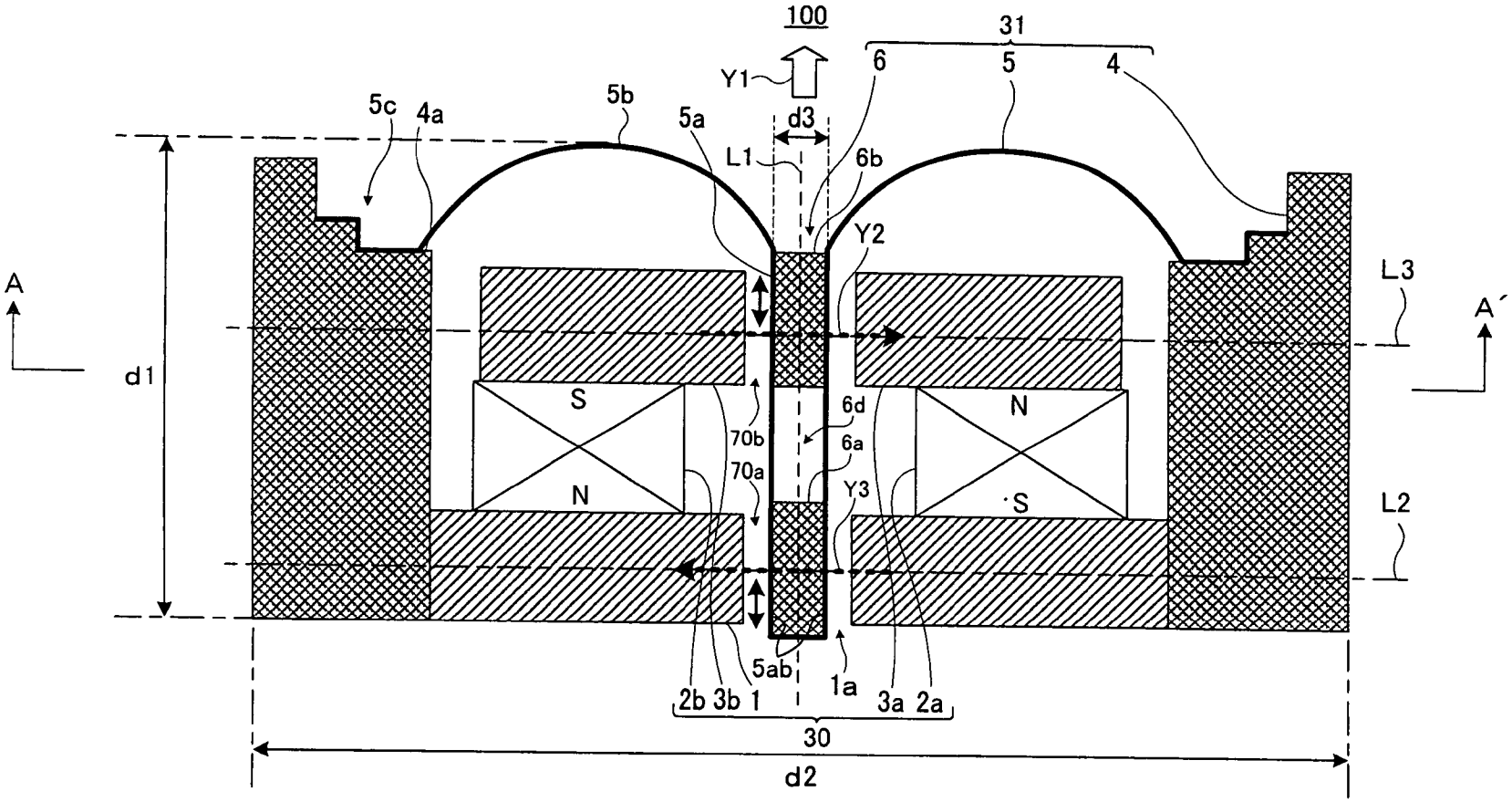
FIG. 3 is a cross-sectional view showing the configuration of the speaker device according to the first embodiment.

FIG. 1A shows a plane view of a speaker device 100 according to a first embodiment of the present invention when observed from a sound output direction thereof. FIG. 1B shows a side view of the speaker device 100 shown in FIG. 1A. FIG. 2 shows a disassembly perspective view corresponding to one side of the speaker device 100 taken along a cutting line A-A' passing through its central axis L1 shown in FIG. 1A. FIG. 3 is a cross-sectional view of the speaker device 100 taken along the cutting line A-A' shown in FIG. 1A, and it is also a cross-sectional view thereof when cut by a plane passing through the central axis L1. Hereinafter, a description will be given of the configuration of the speaker device 100 according to the first embodiment of the present invention.

The speaker device 100 mainly includes an internal-magnet-type magnetic circuit 30 having a yoke 1, a pair of magnets 2*a* and 2*b* and a pair of plates 3*a* and 3*b*, a frame 4, and a vibration system 31 having a diaphragm 5 and a voice coil 6. Hereinafter, for convenience of explanation, when each of the magnets and/or each of the plates are distinguished, they are individually expressed, like "magnet 2*a* " and"plate 3*a*". Meanwhile, when they are not particularly distinguished, they are expressed as the magnet 2 and the plate 3.

First, a configuration of the magnetic circuit 30 will be explained.

The yoke 1 is formed into a flat plate shape and a rectangular plane shape. In addition, the yoke 1 has an opening 1*a* formed into an elongated shape at a substantially central position in its lateral direction and extending in its longitude direction. The opening 1*a* is formed to be longer than a length of an extending direction (longitude direction) of a recessed part 5*a* of the diaphragm 5 described later. In the opening 1*a*, a magnetic gap 70*a* in which the magnetic flux (magnetic force) of the pair of magnets 2*a* and 2*b* described later is concentrated is formed. In this embodiment, the direction of the magnetic flux in the magnetic gap 70*a* is set to the direction of an arrow Y3. In addition, the opening 1*a* has a function to outwardly output the unnecessary air in the speaker device 100 to the outside thereof at the time of movement of the diagram 5 to the side of the yoke 1. Thereby, it can be prevented that the pressure (i.e., back pressure) in the speaker device 100 becomes high.

Each of the pair of magnets 2*a* and 2*b* is formed into a rectangular parallelepiped shape and an angular pole shape. The relative size and magnetic force of the magnets 2*a* and 2*b* are same. On the yoke 1, the magnets 2*a* and 2*b* are provided at positions opposite to each other with a constant space therebetween. A positional relation of the S-pole and the N-pole of the magnets 2*a* is reverse to the positional relation of the S-pole and the N-pole of the magnet 2*b*, i.e., opposite to each other with respect to the vibration direction of the diaphragm 5. Concretely, the lower surface of the magnet 2*a*, neighboring to the yoke 1, is magnetized to the S-pole, and the upper surface of the magnet 2*a*, neighboring to the plate 3*a*, is magnetized to the N-pole. Correspondently, the lower surface of the magnet 2*b*, neighboring to the yoke 1, is magnetized to the N-pole, and the upper surface of the magnet 2*b*, neighboring to the plate 3*b*, is magnetized to the S-pole. In the present invention, the positional relation of the S-pole and the N-pole of the magnets 2*a* and 2*b* is not limited to the configuration.

Each of the pair of plates 3*a* and 3*b* is formed into a rectangular parallelepiped shape or a flat plate shape. The length in the longitudinal direction of each of the plates 3*a* and 3*b* is set to the substantially same length as that in the longitudinal direction of the magnet 2. The plate 3*a* is mounted on the magnet 2*a*, and the plate 3*b* is mounted on the magnet 2*b*. The plates 3*a* and 3*b* are opposite to each other with a constant space, and a constant gap is formed therebetween. In the gap, the magnetic flux of the pair of magnets 2*a* and 2*b* is concentrated. Namely, in the gap between the plates 3*a* and 3*b*, another magnetic gap 70*b* other than the magnetic gap 70*a* is formed. The direction of the magnetic flux in the magnetic gap 70*b* is set to the direction of an arrow Y2.

As described above, in the magnetic circuit 30, the magnetic force of the pair of magnets 2*a* and 2*b* operates on the magnetic gaps 70*a* and 70*b*, respectively, and the magnitude of the magnetic force generated in the magnetic gaps 70*a* and 70*b* is set to the relatively same magnitude. In addition, the magnetic flux is generated in the direction of the arrow Y3 in the magnetic gap 70*a*, and the magnetic flux is generated in the direction of the arrow Y2 opposite to the arrow Y3 in the magnetic gap 70*b*. The directions of the magnetic flux in the magnetic gaps 70*a* and 70*b* are set to the relatively opposite directions.

Next, the frame 4 will be explained. The frame 4 is formed into a cylindrical shape. When planarly observed, the frame 4 is formed into an elongated circular or ellipse shape and an annular (ring) shape. On the upper end surface of the frame 4, a step part 4*a* formed into a step state, supporting an outer peripheral portion of the diaphragm 5, is provided. The yoke 1 is mounted on the lower end portion of the frame 4, and the frame 4 houses the magnetic circuit 30.

Next, a description will be given of a configuration of the vibration system 31.

The diaphragm 5 is formed into an elongated circular or ellipse plane shape. Additionally, the diaphragm 5 has a recessed part 5*a* arranged at a central position thereof and extending in the longitudinal direction, a sound output part 5*b* arranged around the recessed part 5*a* and having a semicircle cross-section, and a step part 5*c* provided in an outer peripheral portion of the sound output part 5*b* and having a cross-section formed into a step state.

The sound output part 5*b* outputs the sound and has a function of an edge for absorbing the unnecessary vibration at the time of the sound reproduction. In addition, the length in the lateral direction of the sound output part 5*b* occupies the major part of the length of the lateral direction of the diaphragm 5. The recessed part 5*a*, which is formed into an elongated shape and a sack-like or U-shaped cross-section, extends in the direction in parallel with the direction substantially orthogonal with respect to the arrow Y2 direction and the arrow Y3 direction, being the extending direction of the magnetic flux. The depth of the recessed part 5*a* is set to the substantially same value as the distance from the rear surface of the yoke 1 to the upper surface of the plate 3. The recessed part 5*a* is arranged in the vicinity of the central axis L1 of the speaker device 100, i.e., at the substantially central position in the magnetic circuit 30. Therefore, the vicinity of the lower end part of the recessed part 5*a* is positioned in the opening 1*a*, and the vicinity of the central part of the recessed part 5*a* is positioned between the pair of magnets 2*a* and 2*b*. Moreover, the vicinity of the upper end part of the recessed part 5*a* is positioned between the pair of plates 3*a* and 3*b*. The voice coil 6 is arranged in the recessed part 5*a*, which supports the voice coil 6. The step part 5*c* of the diaphragm 5 becomes engaged with the step part 4*a* of the frame 4. Thereby, the diaphragm 5 is supported by the frame 4.

The voice coil 6, including a pair of lead wires (not shown) having a plus lead wire and a minus lead wire, is wound to have a plane shape in an elongated circular (ring) state. The plus lead wire is input wiring of an L(or R)-channel signal, and the minus lead wire is input wiring of a ground(GND) signal. Each of the lead wires is electrically connected to each output wiring of an amplifier (not shown). Therefore, a signal and power (hereinafter, simply referred to as "sound current", too) are inputted to the voice coil 6 from the amplifier via each of the lead wires, respectively.

Moreover, the voice coil 6 includes the first parallel part 6*a* extending in one direction, a second parallel part 6*b*, arranged opposite to the first parallel part 6*a* with a constant gap 6*d* and extending in a direction in parallel with the first parallel part 6*a*, and plural connection parts 6*c* connecting each end of the first parallel part 6*a* and each correspondent end of the second parallel part 6*b*. The voice coil 6 is arranged in the recessed part 5*a* of the diaphragm 5.

The length in the longitudinal direction of the first parallel part 6*a* is set to the substantially same length as the length in the longitudinal direction of the recessed part 5*a* of the diaphragm 5. The first parallel part 6*a* and the second parallel part 6*b*, arranged in the recessed part 5*a* of the diaphragm 5, are sandwiched and fixed by side surfaces 5*ab* of the recessed part 5*a*. The length in the longitudinal direction of the second parallel part 6*b* is set to the substantially same length as the length in the longitudinal direction of the first parallel part 6*a*. In addition, a constant gap 6*d* is formed between the first parallel part 6*a* and the second parallel part 6*b*, and the second parallel part 6*b* is positioned above the first parallel part 6*a* in the recessed part 5*a* of the diaphragm 5. The first parallel part 6*a* is positioned in the opening 1*a* of the yoke 1, i.e., in the magnetic gap 70*a*, and the second parallel part 6*b* is positioned between the plates 3*a* and 3*b*, i.e., in the other magnetic gap 70*b*. That is, the gap 6*d* of the voice coil 6 is set to such a size that the first parallel part 6*a* is positioned in the magnetic gap 70*a* and the second parallel part 6*b* is positioned in the other magnetic gap 70*b*. In a preferred example, in order to maintain the appropriate vibration state of the voice coil 6 at the time of the sound reproduction, the straight line passing through the center in the thickness direction of the first parallel part 6*a* is preferably positioned on the straight line L2 passing through the center in the thickness direction of the yoke 1, and the straight line passing through the center in the thickness direction of the second parallel part 6*b* is preferably positioned on the straight line L3 passing through the center in the thickness direction of the pair of plates 3*a* and 3*b*. "Thickness direction" means a vibration direction of the voice coil 6.

In the voice coil 6 having the configuration, since the sound current flows in a circular manner, the direction of the sound current flowing in the first parallel part 6*a* and the direction of the sound current flowing in the second parallel part 6*b* relatively become opposite, as shown in FIG. 2. Namely, in FIG. 2, when the sound current is assumed to flow in the arrow Y4 direction in the first parallel unit 6*a*, the sound current flows in the arrow Y5 direction opposite to the arrow Y4 direction in the second parallel part 6*b*.

In the above-mentioned speaker device 100, the sound current outputted from the amplifier is inputted to the voice coil 6 via each of the lead wires of the voice coil 6. Thereby, the driving force is generated at the first parallel part 6*a* and the second parallel part 6*b* of the voice coil 6 in the two magnetic gaps 70*a* and 70*b*, respectively. The magnitude of the magnetic force generated in the magnetic gap 70*a* and the magnitude of the magnetic force generated in the other magnetic gap 70*b* are set to the same value, as described above, and the sound current of the same amount flows in the first parallel part 6*a* and the second parallel part 6*b* in the relatively opposite direction. Therefore, the first parallel part 6*a* and the second parallel part 6*b* vibrate with the driving force of the same amount and in the same direction in accordance with Fleming's left-hand rule. Concretely, the first parallel part 6*a* and the second parallel part 6*b* vibrate with the driving force of the same amount in the direction of the central axis L1 of the speaker device 100 and in the same direction, with respect to the straight line L2 passing through the center in the thickness direction of the yoke 1 and with respect to the straight line L3 passing through the center in the thickness direction of the pair of the plates 3*a* and 3*b*, respectively. In this manner, the speaker device 100 outputs the acoustic wave in the direction of the arrow Y1 via the sound output part 5*b* of the diaphragm 5.

The first embodiment having the above-mentioned configuration has characteristic operation and effect explained below.

Particularly, in the speaker device 100 according to the first embodiment, the diaphragm 5 having an elongated circular or ellipse plane shape includes the recessed part 5*a* formed into an elongated shape and a sack-like or U-shaped cross-section, in which the first parallel part 6*a* and the second parallel part 6*b* of the voice coil 6 are arranged. In the recessed part 5*a*, the first parallel part 6*a* is arranged in the magnetic gap 70*a* formed in the opening 1*a* of the yoke 1, and the second parallel part 6*b* is arranged in the additional magnetic gap 70*b* formed between the pair of plates 3*a* and 3*b*. Therefore, the speaker device 100 forms 2-magnetic-gap and 2-voice-coil system. Additionally, the speaker device 100 includes the pair of magnets 2*a* and 2*b* having the magnetic force of the relatively same magnitude, and their magnetization state between the S-pole and the N-pole is set to the upside-down positional relation with respect to the vibration direction of the diaphragm 5. Thereby, the direction of the magnetic flux in the magnetic gap 70*a* and the direction of the magnetic flux in the other magnetic gap 70*b* become relatively opposite. Therefore, it becomes possible to vibrate the first parallel part 6*a* and the second parallel part 6*b* with the driving force of the same amount in the same direction. Thus, the speaker device 100 can increase the driving force of the voice coil at the time of the sound reproduction, as compared with the speaker device (1-magnetic-gap and 1-voice-coil system) having the voice coil in one magnetic gap. Thereby, the high sensitivity and the high efficiency of the speaker device 100 can be realized.

Therefore, recently the speaker device 100 is preferably usable as the speaker device for the call-indicating part of the mobile phone for which the high sensitivity is necessary, or as the speaker device loaded on various kinds of electronic equipments for the mobile or for the neighboring acoustic field.

In addition to this, since the speaker device 100 according to the first embodiment does not include the normal voice coil, it can be light by the amount. That is, the number of parts of the speaker device 100 can be reduced, and the high sensitivity and the high efficiency thereof can be realized. At the same time, the manufacturing cost can be low.

The speaker device 100 according to the first embodiment includes the elongated recessed part 5*a* having a sack-like or U-shaped cross-section at the central position in the lateral direction of the diaphragm 5 and extending in the longitude direction of the diaphragm 5. The voice coil 6 including the first parallel part 6*a* and the second parallel part 6*b* is arranged in the recessed part 5*a*. Thereby, in FIG. 3, the center in the direction of the width d3 of the voice coil 6 and the center in the lateral direction of the diaphragm 5 can coincide with each other, and the relative positional relation between the voice coil 6 and the diaphragm 5 can be set in the appropriate state.

In addition to the configuration, the recessed part 5*a* in which the voice coil 6 having the first parallel part 6*a* and the second parallel part 6*b* is arranged is provided to be housed in the substantially central position in the magnetic circuit 30. That is, the recessed part 5*a* is positioned at the substantially central position in the opening 1*a* of the yoke 1 (in the magnetic gap 70*a*), at the substantially central position between the pair of magnets 2*a* and 2*b*, and at the substantially central position between the pair of plates 3*a* and 3*b* (in the magnetic gap 70*b*). Thereby, the distance from the upper surface of the sound output part 5*b* of the diaphragm 5 to the rear surface of the yoke 1, i.e., the height d1 of the speaker device 100, can be small. Thus, the thin speaker device can be realized.

Additionally, since the recessed part 5*a* of the diaphragm 5 is formed to extend in the direction substantially orthogonal with respect to the direction Y2 of the magnetic flux occurring in the magnetic gap 70*a* and the direction Y3 of the magnetic flux occurring in the additional magnetic gap 70*b*, the first parallel part 6*a* and the second parallel part 6*b* are arranged in the direction in parallel with the extending direction of the recessed part 5*a*, respectively, and the first parallel part 6*a* and the second parallel part 6*b* are arranged in the recessed part 5*a*, the width d2 in the lateral direction of the speaker device 100 can be small, and the slim speaker device 100 can be realized. The diaphragm 5 is formed into an elongated circular or ellipse plane shape, and the recessed part 5*a* of the diaphragm 5 is formed into the elongated shape and a sack-like or U-shaped cross-section to be at the substantially central position of the diaphragm 5 and the magnetic circuit 30. Therefore, the speaker device 100 can be slim.

Therefore, the speaker device 100 can be preferably used as the speaker device for the receiver part and/or for the call-indicating part of the mobile phone recently becoming thinner and slimmer. The speaker device 100 according to the first embodiment, which can be thin and slim, can be preferably used for various kinds of electronic equipments for the above-mentioned mobile or neighboring acoustic field, other than the speaker device for the mobile phone, too.

The first parallel part 6*a* and the second parallel part 6*b* of the voice coil 6 is sandwiched and fixed by the side surfaces 5*ab* of the recessed part 5*a* of the diaphragm 5. Thereby, the voice coil 6 is stably retained by the recessed part 5*a*, and it becomes possible to overcome the disadvantage of easily bending in the vibration direction of the voice coil 6, i.e., in the direction of the central axis L1 of the speaker device 100. Thereby, the voice coil 6 hardly bends in the direction of the central axis L1 being the vibration direction thereof. Thus, the first parallel part 6*a* can be appropriately positioned in the magnetic gap 70*a*, and the second parallel part 6*b* can be appropriately positioned in the other magnetic gap 70*b*. Moreover, since the step part 5*c* provided at the outer peripheral portion of the diaphragm 5 is made engaged with the step part 4*a* of the frame 4, the center in the lateral direction of the diaphragm 5, i.e., the center in the width direction of the recessed part 5*a*, can be substantially coincident with the central axis L1 of the speaker device 100. Thereby, the center in the direction of the width d3 of the voice coil 6 can be substantially coincident with the central axis of the frame 4, the diaphragm 5 and the magnetic circuit 30, i.e., the central axis L1 of the speaker device 100. As a result, the diaphragm 5 can be smoothly and stably moved at the time of the sound reproduction, and the strength of the entire vibration system 31 can be sufficiently ensured.

Further, in the speaker device 100 according to the first embodiment, the minimum resonance frequency f0 can be lowered by the configuration of the diaphragm 5, as compared with a comparative example explained below. Therefore, it is advantageous that the low frequency sound output can be easily realized and the speaker device 100 is preferably usable as the speaker for the mobile phone for which the high sensitivity is necessary.

Figure 4:
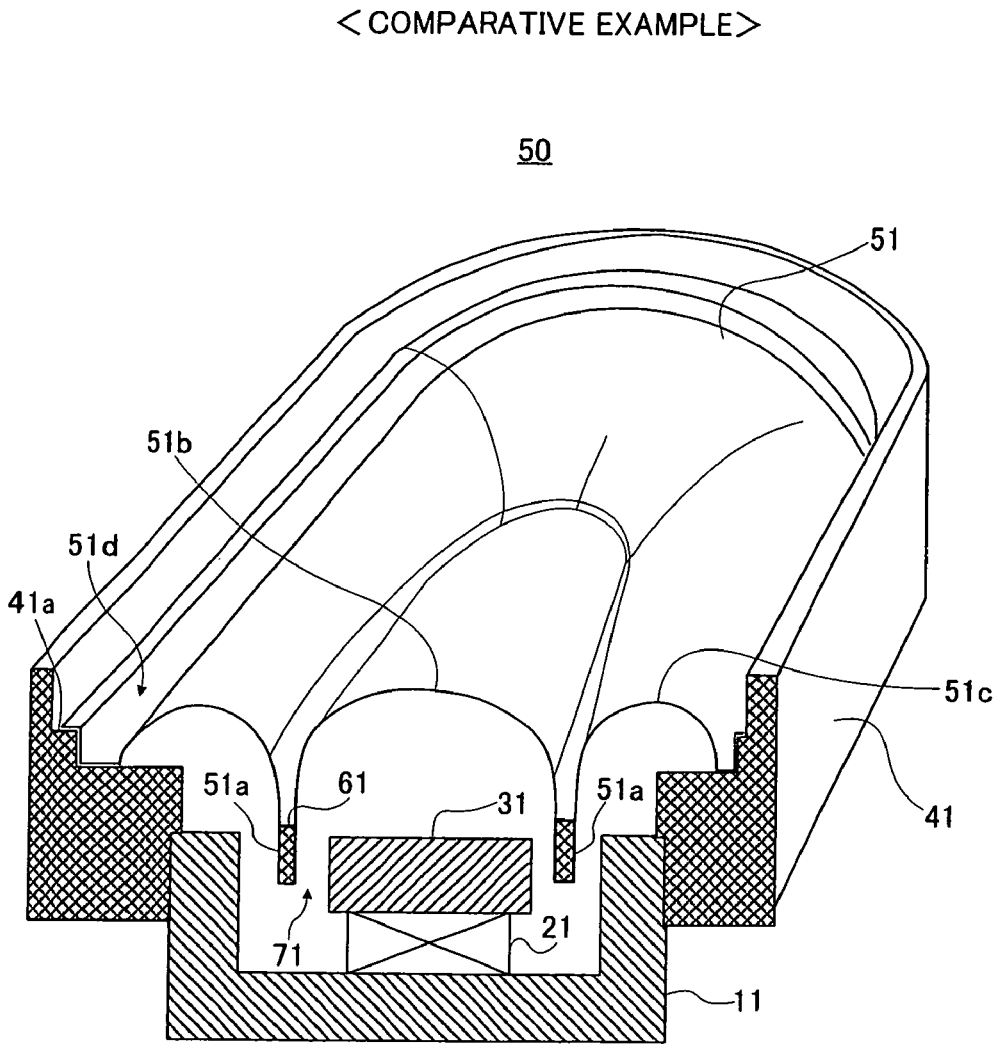
FIG. 4 is a cross-sectional view showing a configuration of a speaker device according to a comparative example.

First, a description will be given of a configuration of a speaker device according to the comparative example, with reference to FIG. 4. FIG. 4 shows a one-side perspective view of a speaker device 50 according to the comparative example.

The speaker device 50 according to the comparative example includes a magnetic circuit including a yoke 11 having an elongated circular or ellipse plane surface and a recessed cross-section; a magnet 21 mounted on the middle position on the yoke 11 and formed into a rectangular parallelepiped shape and angular pole shape; and a flat plate 31 mounted on the magnet 21 and having the substantially same length as that in the longitudinal direction of the magnet 21, a frame 41 having a shape similar to that of the first embodiment, a vibration system including a diaphragm 51 supported by the frame 41; and a voice coil 61 supported by the diaphragm 51.

In the magnetic circuit, an upper end part of the yoke 11 and the plate 31 are opposite to each other with a constant space, and a magnetic gap 71 is formed therebetween.

The frame 41 is mounted in the vicinity of the upper end part of the yoke 11. A step part 41*a* having a step shape is provided at an outer peripheral portion on the side of the upper end part of the frame 41.

The diaphragm 51, having a function to output the sound, includes a sound output part 51*b* having a semicircle cross-section, an edge 51*c* provided around the sound output part 51*b* with a constant space and having an Ω-shaped cross-section, a recessed part 51*a* provided between the sound output part 51*b* and the edge 51*c* and having a recessed cross-section, and a step part 51*d* provided at an outer peripheral edge portion of the edge 51*c* and having a step-state cross-section. The step part 51*d* of the diaphragm 51 becomes engaged with the step part 41*a* of the frame 41. Thereby, the sound output part 51*b* is arranged at a position covering the plate 31, and the recessed part 51*a* is arranged in the magnetic gap 71. The voice coil 61 wound in a ring state is arranged in the recessed part 51*a*. Therefore, the voice coil 61 is positioned in the magnetic gap 71. In the comparative example, when the sound current is inputted to the voice coil 61, the driving force occurs to the voice coil 61 in the magnetic gap 71, and the acoustic wave is outputted from the sound output part 51*b* of the diaphragm 51.

In the comparative example having the above-mentioned configuration, since the edge width becomes small by the configuration, which will be explained later, the position of the voice coil 61 is away from a central position of the speaker device 50. Thereby, there is such a problem that the minimum resonance frequency f0 becomes higher and the low frequency sound is hardly obtained, as compared with the first embodiment. Thus, the speaker device according to the comparative example is unusable as the speaker for the mobile phone for which the high sensitivity is necessary. This point will be explained with reference to FIGS. 5A and 5B, hereinafter.

Figure 5A:
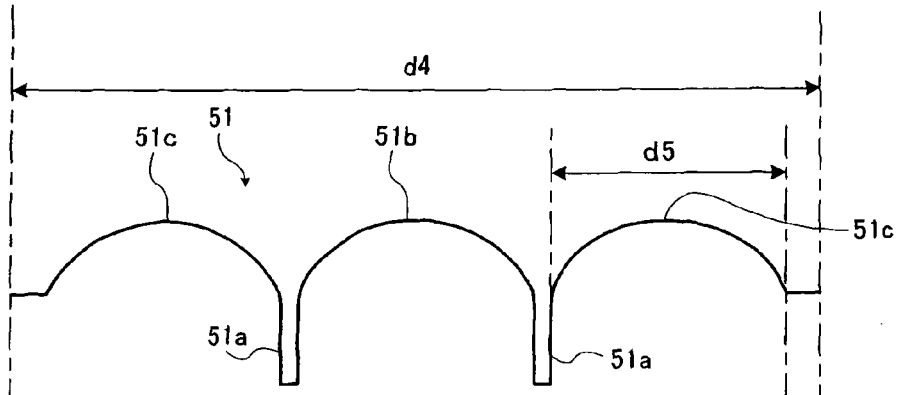
FIGS. 5A and 5B are cross-sectional views of a diaphragm for explaining operation and effect according to the first embodiment, as compared with the comparative example.
Figure 5B:
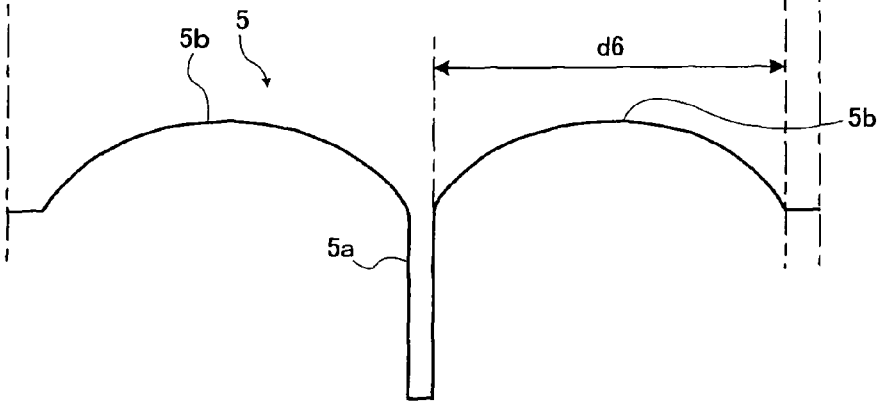

FIG. 5A is a cross-sectional view corresponding to the lateral direction of the diaphragm 51 according to the comparative example. Meanwhile, FIG. 5B is a cross-sectional view corresponding to the lateral direction of the diaphragm 5 according to the first embodiment.

The length (width) in the lateral direction of the diaphragm 51 according to the comparative example and the length (width) in the lateral direction of the diaphragm 5 according to the first embodiment are set to the same length d4, and the thicknesses of them are also set to the same (not shown). In the comparative example, the width of the edge 51*c* of the diaphragm 51 is set to d5. Meanwhile, the width of the sound output part 5*b* serving as the edge in the first embodiment is set to d6(>d5). Namely, it can be said that the edge width according to the first embodiment is larger than that of the comparative example. In addition, the length in the lateral direction of the sound output part 5*b* occupies the major part of the length in the lateral direction of the diaphragm 5. In this point, it can be said that the edge width is large. Generally, as the edge width becomes larger, the edge becomes softer. Therefore, the resonance frequency of the speaker device can be reduced, and the voice coil can be close to the central position of the speaker device. Thereby, since the minimum resonance frequency f0 can be lowered, the low frequency sound output can be easily obtained. In the first embodiment, as compared with the comparative example, the minimum resonance frequency f0 can be lowered, and the low frequency sound output can be easily obtained. As a result, the speaker device including the diaphragm 5 according to the first embodiment can obtain the high sensitivity, and it can be preferably used for the speaker of the mobile phone.

Second Embodiment

Figure 6:
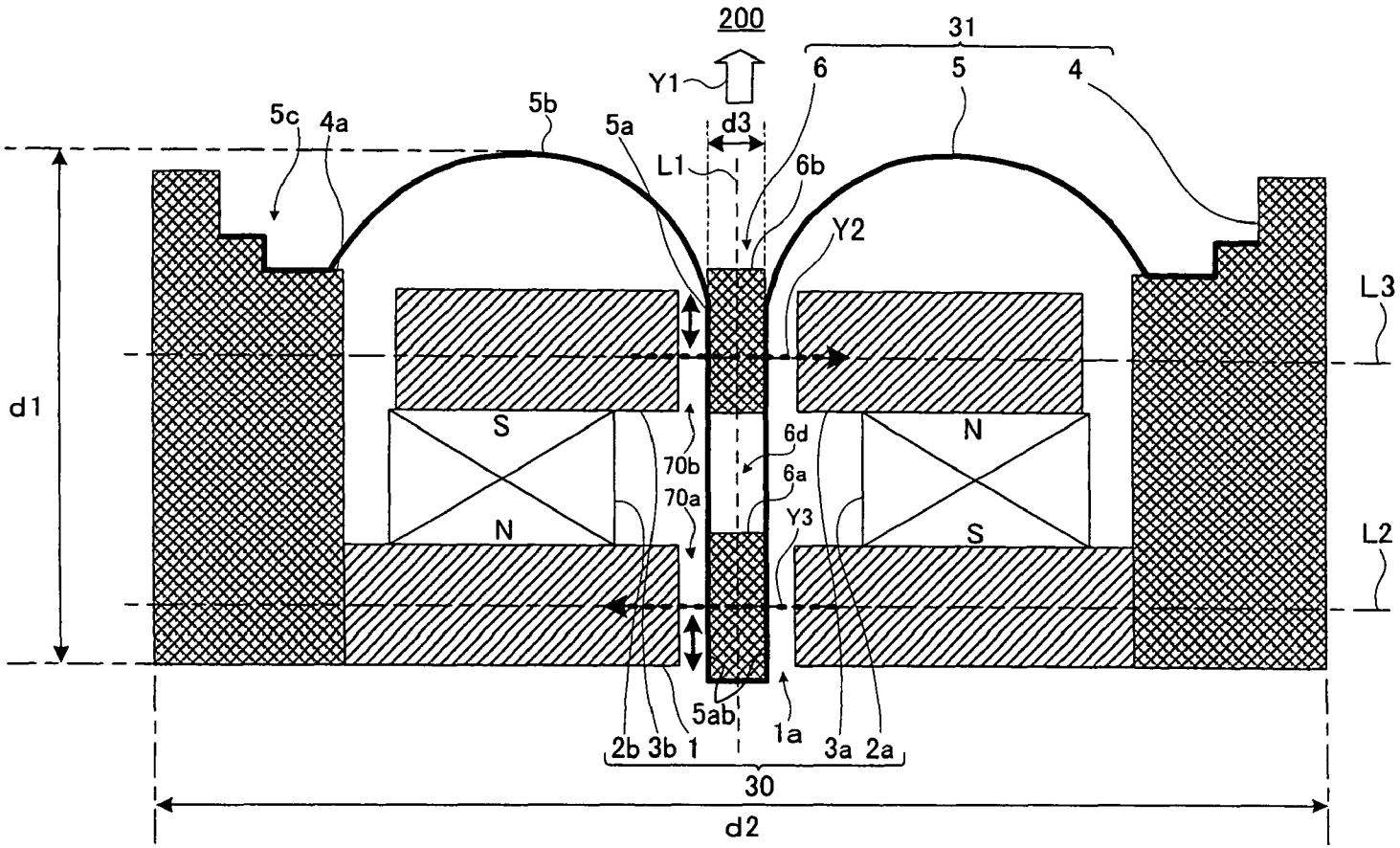
FIG. 6 is a cross-sectional view showing the configuration of the speaker device according to a second embodiment of the present invention.

Next, a description will be given of a configuration of a speaker device 200 according to a second embodiment of the present invention, with reference to FIG. 6. FIG. 6 shows a cross-sectional view of a speaker device 200 of the second embodiment when cut by a plane passing through the central axis L1. Hereinafter, the same reference numerals are given to the same components as those common with the first embodiment, and explanations thereof are simplified or omitted.

When the second embodiment is compared with the first embodiment, their configurations are substantially common. However, the entire first parallel part 6*a* and the entire second parallel part 6*b* arranged above it, being the components of the voice coil 6, are arranged in the recessed part 5*a* of the diaphragm 5 in the first embodiment, but the entire first parallel part 6*a* and the part of the second parallel part 6*b* arranged above it, being the components of the voice coil 6, are arranged in the recessed part 5*a* of the diaphragm 5 in the second embodiment. In this point, the second embodiment is structurally different from the first embodiment. Thereby, at the time of manufacturing of the diaphragm 5, the formation of the depth of the diaphragm 5 can be shallow to some extent, and the formation of the diaphragm 5 can be improved. Namely, by the configuration, at the time of the manufacturing of the diaphragm 5, the half of the recessed part 5*a* of the diaphragm 5, at which the second parallel part 6*b* is arranged, is held and a taper is made large and wide in the middle of the recessed part 5*a*. Thereby, the outer part of the recessed part 5*a* can be formed. Therefore, the formation of the diaphragm 5 can be improved.

Third Embodiment

Figure 7:
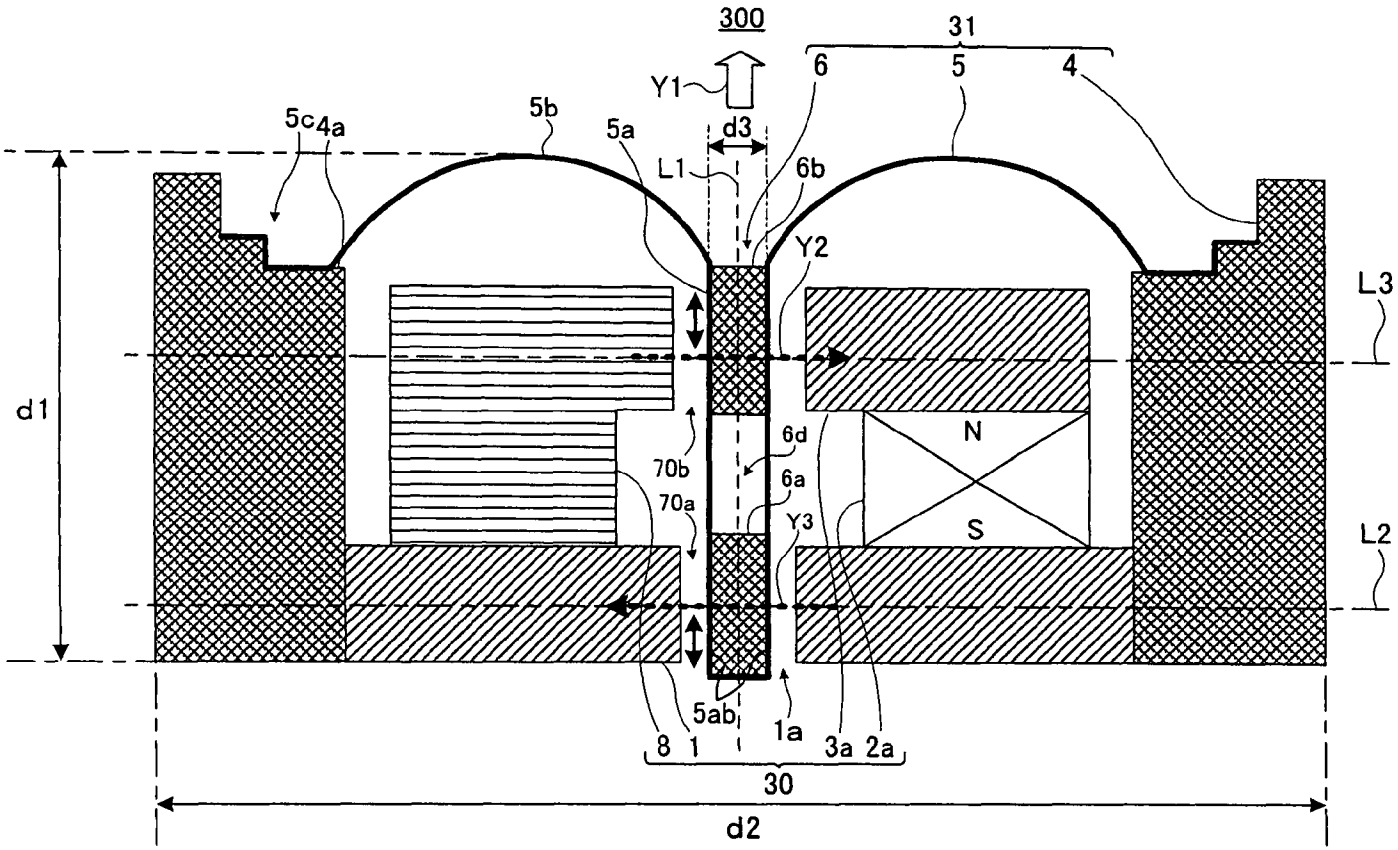
FIG. 7 is a cross-sectional view showing the configuration of the speaker device according to a third embodiment of the present invention.

Next, a description will be given of a configuration of a speaker device 300 according to a third embodiment of the present invention, with reference to FIG. 7. FIG. 7 shows a cross-sectional view of the speaker device 300 according to the third embodiment when cut by a plane passing through the central axis L1. Hereinafter, the same reference numerals are given to the components common with those of the first embodiment, and explanations thereof are simplified or omitted.

When the third embodiment and the first embodiment are compared, their configurations are substantially common. However, they are different in the number of magnets 2 and plates 3.

Concretely, the speaker device 300 according to the third embodiment includes the magnet 2*a* and the plate 3*a*, but it does not include the magnet 2*b* and the plate 3*b*. Instead, in the third embodiment, the speaker device 300 includes a magnetic body 8 at the position corresponding to the magnet 2*b* and the plate 3*b*. In a preferred example, the magnetic body 8 can be made of a metal material such as iron. The magnetic body 8 is formed into a shape obtained by integrating the magnet 2*b* and the plate 3*b* mounted thereon shown in FIG. 1. Thus, the magnetic body 8 has the same length as the length in the longitude direction of the magnet 2*b*, and the thickness (height) of the magnetic body 8 is set to a value obtained by adding the thickness (height) of the magnet 2*b* and the thickness (height) of the plate 3*b*. Thereby, the vicinity of the upper end part on the inner wall of the magnetic body 8 is opposite to the plate 3*a* with a constant space, and the magnetic gap 70*b* is formed therebetween. In the third embodiment, the direction of the magnetic flux in the magnetic gap 70*b* is set to the direction of the arrow Y2, similarly to the first embodiment.

The third embodiment having the above-mentioned configuration has characteristic operation and effect explained below.

Generally, when the number of magnets and the number of plates become small, the sensitivity is lowered by the amount. However, according to the specification of the electronic equipments on which the speaker device is loaded, the high sensitivity and efficiency are not always necessary. For example, as the speaker device used for the mobile phone, there are speakers of two kinds, i.e., for the receiver part and for the call-indicating part. In the case of the speaker device for the receiver, the priorities of the miniaturization and lowering the minimum resonance frequency f0 (low f0) are high as the specification, but the high sensitivity and efficiency are not necessary so much. Thus, in this case, in consideration of the manufacturing cost, it is preferred to apply not the speaker device according to the first embodiment but the speaker device according to the third embodiment, as the receiver of the mobile phone, for example. Namely, as the speaker device preferable for the mobile phone for which the high sensitivity and efficiency are not necessary so much, it is preferable to apply, instead of the speaker device 100 according to the first embodiment, the speaker device 300 according to the third embodiment, whose manufacturing cost is lower by the amount in spite of the slightly inferior sensitivity and efficiency because of the smaller number of magnets, as compared with the speaker device 100 according to the first embodiment. The other operation and effect according to the third embodiment are substantially same as those of the first embodiment.

Fourth Embodiment

Figure 8:
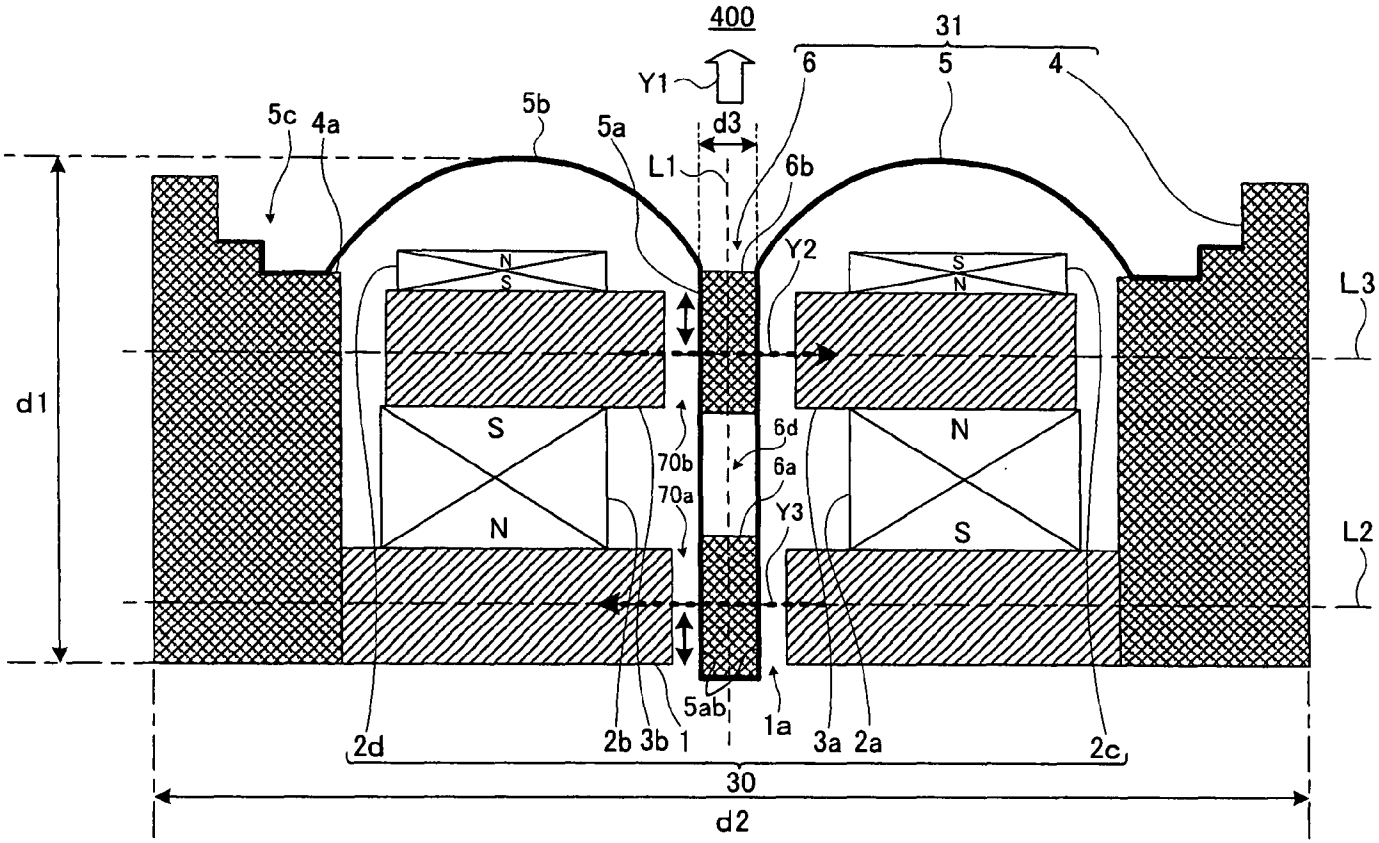
FIG. 8 is a cross-sectional view showing the configuration of the speaker device according to a fourth embodiment of the present invention.

Next, a description will be given of a configuration of a speaker device 400 according to a fourth embodiment of the present invention, with reference to FIG. 8. FIG. 8 shows a cross-sectional view of the speaker device 400 according to the fourth embodiment when cut by a plane passing through the central axis L1. Hereinafter, the same reference numerals are given to the components common with those of the first embodiment, and explanations thereof are simplified or omitted.

When the fourth embodiment and the first embodiment are compared, their configurations are substantially common. However, the number of magnets in the fourth embodiment is larger than that of the first embodiment.

Concretely, the speaker device 400 according to the fourth embodiment further includes the pair of magnets 2*c* and 2*d* in addition to the pair of magnets 2*a* and 2*b*. In the present invention, in consideration of the manufacturing cost or in accordance with the specification, the speaker device 300 may include the magnet 2*c* or 2*d*. The magnet 2*c* is mounted on the plate 3*a*, and the magnet 2*d* is mounted on the plate 3*b*. The positional relation of the S-pole and the N-pole of one of the pair of the magnets 2*c* and 2*d* is reverse to the positional relation of the S-pole and the N-pole of the other pair of the magnets 2*a* and 2*b*, opposite to each other and sandwiching the corresponding plates 3*a* and 3*b*, with respect to the vibration direction of the diaphragm 5, respectively.

Concretely, the lower surface of the magnet 2*c*, adjacent to the plate 3*a*, is magnetized to the N-pole, and the lower surface of the magnet 2*d*, adjacent to the plate 3*b*, is magnetized to the S-pole. Therefore, the lower surface of the magnet 2*c*, magnetized to the N-pole, and the upper surface of the magnet 2*a*, magnetized to the N-pole, are opposite to each other with sandwiching the plate 3*a*. The lower surface of the magnet 2*d*, magnetized to the S-pole, and the upper surface of the magnet 2*b*, magnetized to the S-pole, are opposite to each other with sandwiching the plate 3*b*. In this manner, since the magnets 2*c* and 2*d* are arranged at the positions reacting against the magnets 2*a* and 2*b*, respectively, they are generally referred to as "reacting magnets".

In the fourth embodiment, in addition to the pair of magnets 2*a* and 2*b*, the magnets 2*c* and 2*d* are further provided as the reacting magnets. Therefore, by the amount of those reacting magnets, the magnetic force in the magnetic field in the magnetic gaps 70*a* and 70*b* can be large. Thereby, the sensitivity and efficiency can be enhanced. The other operation and effect of the fourth embodiment are substantially same as those of the first embodiment.

Fifth Embodiment

Figure 9:
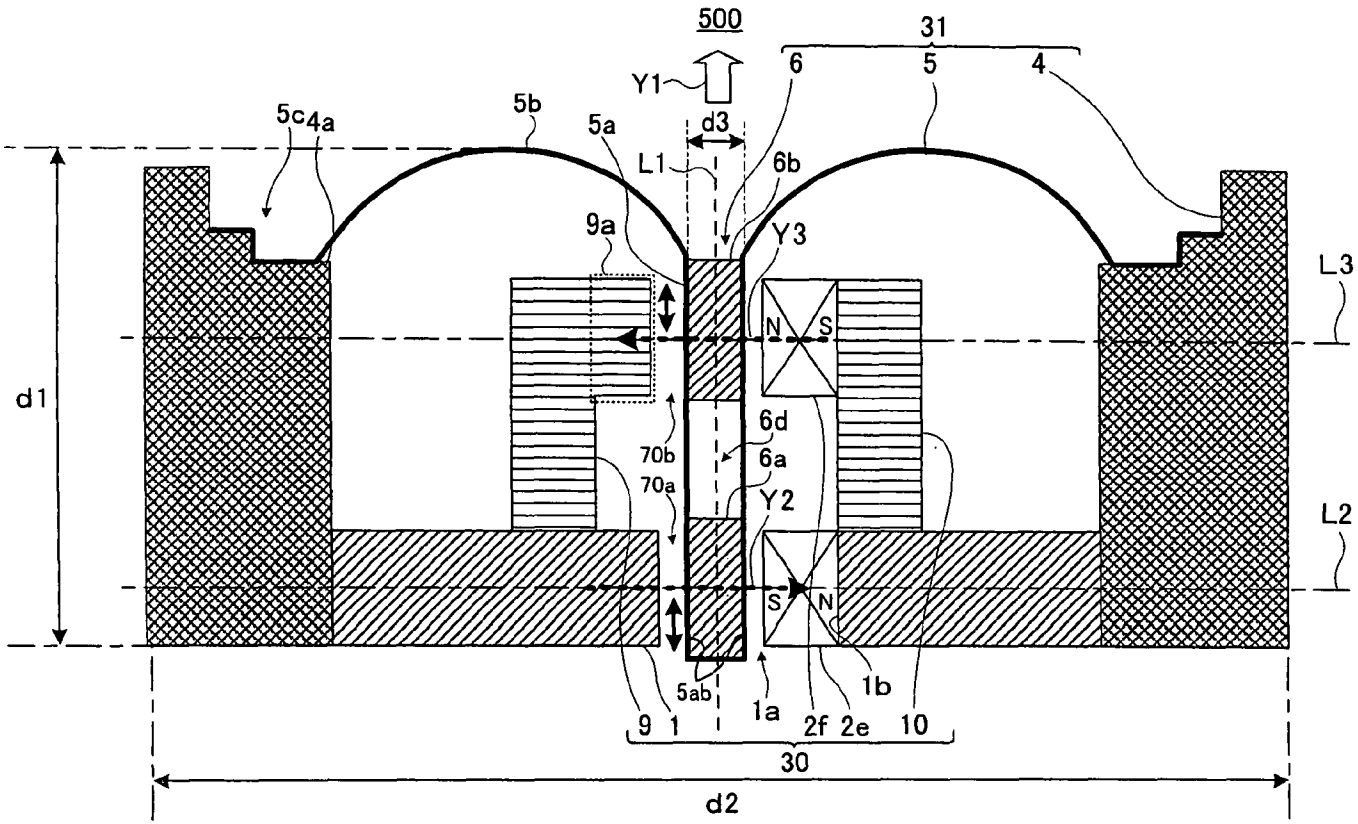
FIG. 9 is a cross-sectional view showing the configuration of the speaker device according to a fifth embodiment of the present invention.

Next, a description will be given of a configuration of a speaker device 500 according to a fifth embodiment of the present invention, with reference to FIG. 9. FIG. 9 shows a cross-sectional view of the speaker device 500 of the fifth embodiment when cut by a plane passing through the central axis L1. Hereinafter, the same reference numerals are given to the components common with those of the first embodiment, and explanations thereof are simplified or omitted.

When the fifth embodiment and the first embodiment are compared, their configurations are substantially common. However, they are different in a point described below.

Namely, first, the speaker device 500 according to the fifth embodiment includes, not the magnet 2*b* and the plate 3*b*, but a magnetic body 9 at the position instead. The magnetic body 9, formed into a hook-shape, has a projecting part 9*a* projecting from one end surface thereof. In addition, the length in the longitude direction of the magnetic body 9 has the substantially same length as the length in each longitude direction of the above-mentioned magnet 2 and plate 3. In a preferable example, the magnetic body 9 may be made of the metal material such as iron. In such a state that the projecting part 9*a* being the component thereof is arranged on the side of the central axis L1 of the speaker device 500, the magnetic body 9 is mounted on the upper surface of the yoke 1.

Additionally, in the speaker device 500, the width (distance) of the opening 1*a* of the yoke 1, corresponding to the arrow Y2 direction being the direction of the magnetic flux, becomes larger than that of the first embodiment. In the speaker device 500, none of the pair of plates 3*a* and 3*b* and the pair of magnets 2*a* and 2*b* are included. Instead, in the vicinity of the position, a pair of magnets 2*e* and 2*f* and a magnetic body 10 are provided.

The magnetic body 10 is formed into a rectangular parallelepiped shape or a flat plane shape, and the length in the longitude direction is set to the same length as that in the longitude direction of the magnetic body 9. In a preferred example, the magnetic body 10 may be made of the same material as that of the magnetic body 9. The magnetic body 10 is mounted on the upper surface of the yokel, and the relatively positional relation between the magnetic bodies 9 and 10 is prescribed as a positional relation substantially symmetrical with respect to the central axis L1 of the speaker device 500.

The magnet 2*e* is formed into a rectangular parallelepiped shape or an angular pole shape. The length of the longitude direction of the magnet 2*e* is same as that in the longitude direction of the magnetic body 10. The cross-sectional area in the lateral direction of the magnet 2*e* becomes smaller than the cross-sectional area in each lateral direction of the magnets 2*a* and 2*b*. The magnet 2*e* is mounted on the position in the vicinity of the magnetic body 10 and on the side wall 1*b* in the opening 1*a* of the yoke 1. Thus, the magnet 2*e* is opposite to the part of the recessed part 5*a* in which the first parallel part 6*a* is arranged, with a constant space. In the opening 1*a*, the magnetic gap 70*a* is formed. In this embodiment, one end surface of the magnet 2*e*, adjacent to the inner wall of the yoke 1, is set to the N-pole, and the other end surface of the magnet 2*e*, positioned oppositely to the one end surface and opposite to the recessed part 5*a*, is set to the S-pole. The direction of the magnetic flux in the magnetic gap 70*a* is set to the direction of the arrow Y2. However, this invention is not limited to this configuration, and the one end surface of the magnet 2*e* may be set to the N-pole and the other end surface opposite to the one end surface may be set to the S-pole.

The magnet 2*f* has the same size and the same magnitude of the magnetic force as that of the magnet 2*e*. The magnet 2*f* is mounted in the vicinity of the upper end part of the side wall of the magnetic body 10, positioned on the side of the central axis L1 of the speaker device 500. The magnet 2*f* is opposite to the magnet 2*e* with a constant space therebetween. In addition, the magnet 2*f* is opposite to the projecting part 9*a* of the magnetic body 9 with a constant space therebetween via the part of the recessed part 5*a* in which the second parallel part 2*b* is arranged. The other magnetic gap 70*b* is formed between the projecting part 9*a* of the magnetic body 9 and the magnet 2*f*. The positional relation of the S-pole and the N-pole of the magnet 2*f* is reverse to the positional relation of the S-pole and the N-pole of the magnet 2*e*, with respect to the vibration direction of the diaphragm 5 and opposite with respect to the extending direction of the magnetic flux. Namely, the one end surface of the magnet 2*f*, adjacent to the magnetic body 10, is set to the S-pole, and the other end surface of the magnet 2*f*, positioned on the side opposite to the one end surface and opposite to the recessed part 5*a*, is set to the N-pole. The direction of the magnetic flux in the magnetic gap 70*b* is set to the direction of the arrow Y3 opposite to the direction of the arrow Y2. However, this invention is not limited to this configuration, and the one end surface of the magnet 2*f* may be set to the N-pole and the other end surface opposite to the one end surface may be set to the N-pole.

As described above, in the fifth embodiment, since the pair of magnets 2*e* and 2*f* are directly arranged in the magnetic gaps 70*a* and 70*b*, respectively, it becomes necessary that the size of the pair of magnets 2*e* and 2*f* is smaller than that of the pair of magnets 2*a* and 2*b*, in order to realize this. Therefore, in this embodiment, the cross-sectional area in each lateral direction of the magnets 2*e* and 2*f* is made smaller than the cross-sectional area in each lateral direction of the magnets 2*a* and 2*b*. Thereby, the speaker device 500 can be lighter than the speaker device 100 according to the first embodiment, and the magnetic efficiency can be improved. "Magnetic efficiency" is the magnitude of the magnetism generated per gram of the magnet. The other operation and effect of the fifth embodiment are substantially same as those of the first embodiment.

Sixth Embodiment

Figure 10:
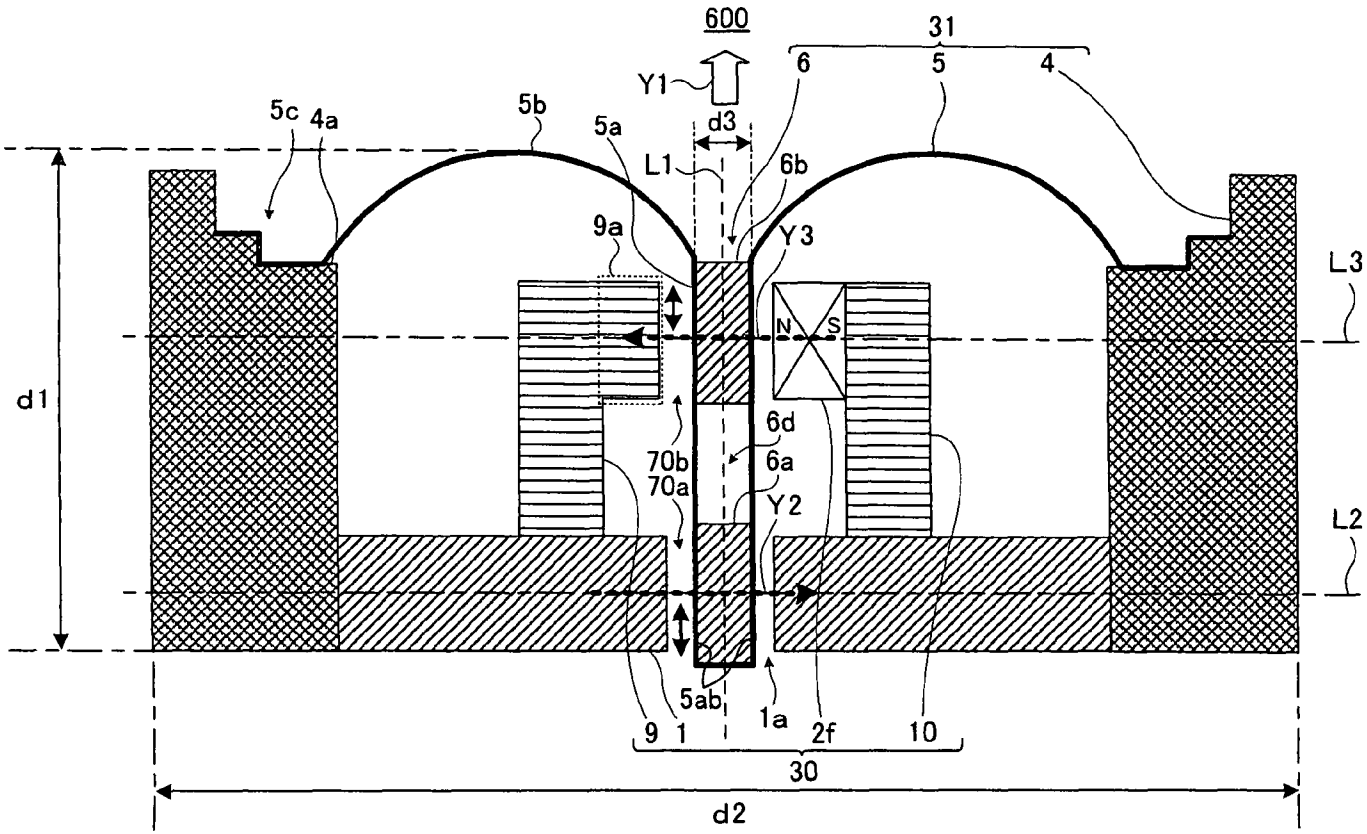
FIG. 10 is a cross-sectional view showing the configuration of the speaker device according to a sixth embodiment of the present invention.

Next, a description will be given of a configuration of a speaker device 600 according to a sixth embodiment of the present invention, with reference to FIG. 10. FIG. 10 shows a cross-sectional view of the speaker device 600 of the sixth embodiment when cut by a plane passing through the central axis L1 thereof. Hereinafter, the same reference numerals are given to the components common with those of the fifth embodiment, and explanations thereof are simplified or omitted.

When the sixth embodiment and the fifth embodiment are compared, they are different in the number of magnets provided in the magnetic gap, but the other configurations thereof are common.

Concretely, the sixth embodiment is structurally largely different from the fifth embodiment in that the speaker device 600 according to the sixth embodiment does not include the magnet 2*e* in the magnetic gap 70*a*. Namely, in the fifth embodiment, the pair of magnets 2*e* and 2*f* are provided, and each of them is directly arranged in the magnetic gaps 70*a* and 70*b*, respectively. Meanwhile, in the sixth embodiment, the magnet 2*f* is provided, which is directly arranged in the magnetic gap 70*b*. In the sixth embodiment, the yoke 1 is formed into the shape of the first embodiment, and the configuration in the vicinity of the opening 1*a*, i.e., the configuration in the vicinity of the magnetic gap 70*a*, is similar to that of the first embodiment. Thereby, as compared with the first embodiment, the speaker device 600 can be further lighter. In the sixth embodiment, though the magnetism efficiency is slightly inferior to that of the fifth embodiment, the magnetism efficiency can be larger than that of the first embodiment. The other operation and effect according to the sixth embodiment is substantially same as those of the first embodiment.

Seventh Embodiment

Figure 11:
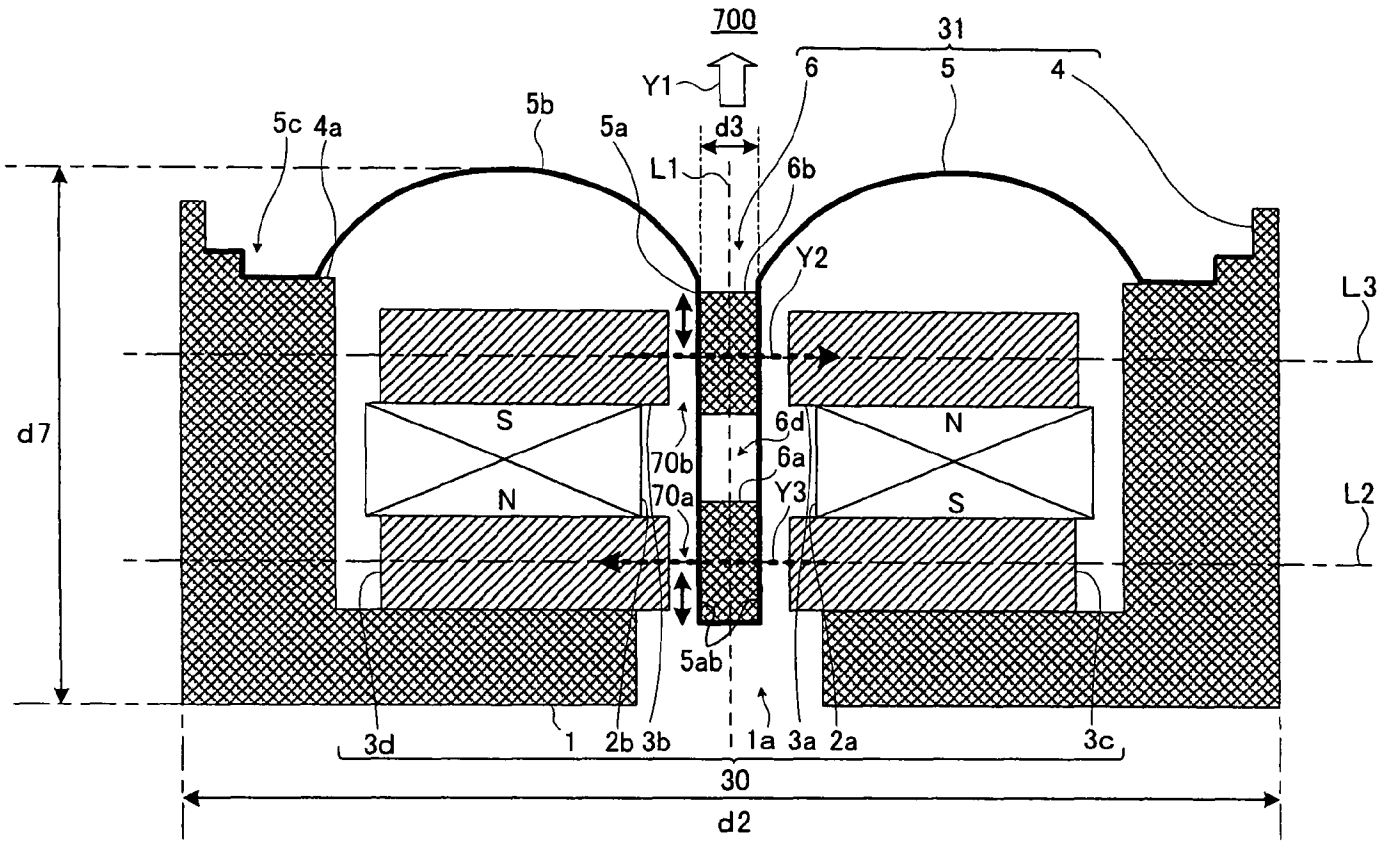
FIG. 11 is a cross-sectional view showing the configuration of the speaker device according to a seventh embodiment of the present invention.

Next, a description will be given of a configuration of a speaker device 700 according to a seventh embodiment of the present invention, with reference to FIG. 11. FIG. 11 shows a cross-sectional view of the speaker device 700 of the seventh embodiment when cut by a plane passing through the central axis L1 thereof. Hereinafter, the same reference numerals are given to the components common with those of the first embodiment, and explanations thereof are simplified or omitted.

When the seventh embodiment is compared with the first embodiment, their configurations are substantially common. However, the seventh embodiment is different from the first embodiment in the number of plates 3.

Namely, the speaker device 700 according to the seventh embodiment further includes a pair of plates 3*c* and 3*d* having the same size as that of the pair of plates 3*a* and 3*b*. Of the pair of plates 3*c* and 3*d*, the plate 3*c* is arranged between the yoke 1 and the magnet 2*a*, and the plate 3*d* is arranged between the yoke 1 and the magnet 2*b*. The magnetic gap 70*a* is formed between the pair of plates 3*c* and 3*d*, and the magnetic gap 70*b* is formed between the pair of plates 3*a* and 3*b*.

As described above, in the seventh embodiment, not only the pair of plates 3*a* and 3*b* but also the pair of plates 3*c* and 3*d* can be included in accordance with the specification of the speaker device. Thereby, the configuration in the magnetic circuit 30 can be symmetry with respect to the central axis L1 of the speaker device 700. Namely, such a configuration that the plate 3*d*, the magnet 2*b* and the plate 3*b* are integrated can be symmetric to such a configuration that the plate 3*c*, the magnet 2*a* and the plate 3*a* are integrated, with respect to the central axis L1 of the speaker device 700. The magnitude of the magnetic force generated in the magnetic gap 70*a* can be further equalized to the magnitude of the magnetic force generated in the magnetic gap 70*b*. However, in the seventh embodiment, the distance from the rear surface of the yoke 1 to the sound output part 5*a* of the diaphragm 5, i.e., the height d7 of the speaker device 700, becomes larger than the height d1 of the speaker device 100 of the first embodiment by the amount of plates 3*c* and 3*d*.

[Modification]

In the above third to seventh embodiments, the entire second parallel part 6*b* being the component of the voice coil 6 is arranged in the recessed part 5*a* of the diaphragm 5. The present invention is not limited to this. In the present invention, similarly to the second embodiment, the part of the second parallel part 6*b* may be arranged in the recessed part 5*a* of the diaphragm 5 in each of the configurations of the above third to seventh embodiments.

Figure 12:
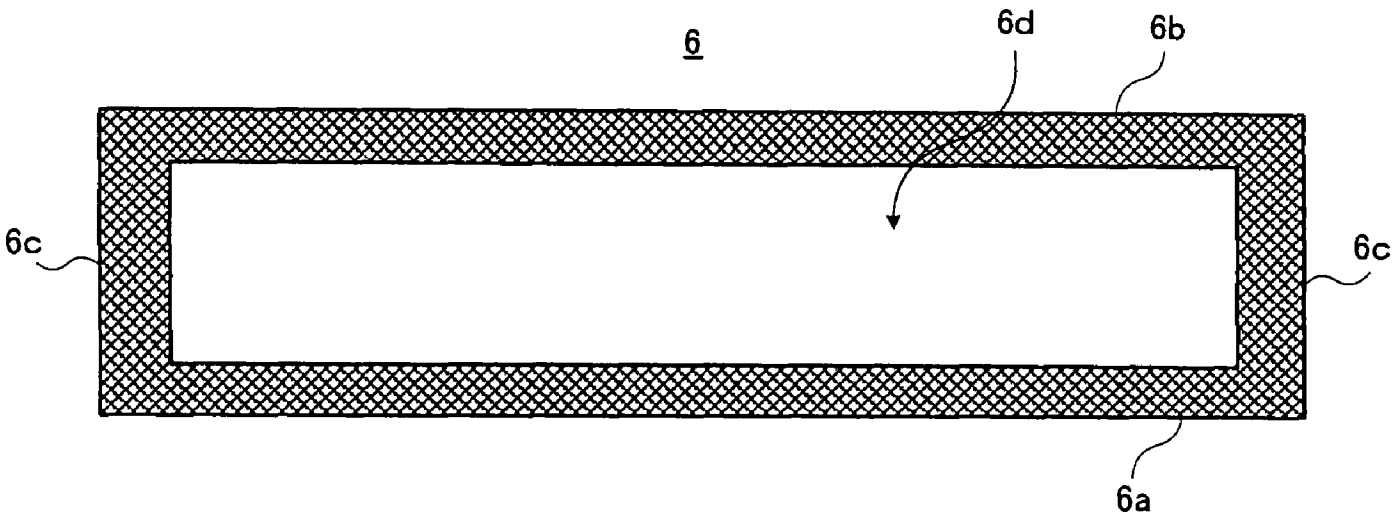
FIG. 12 is a plane view showing a configuration of a voice coil according to a modification.

In addition, in the above first to seventh embodiments, the plane shape of the voice coil 6 is formed into the elongated circular and ring state in order to become suitable for the shape of the speaker device, but the present invention is not limited to this. Namely, in correspondence to the shape of the speaker device, the shape of the voice coil 6 is variously deformable within the scope of the invention. For example, in correspondence to the shape of the speaker device, the voice coil 6 may be formed into an angular and rectangular shape and the plane shape thereof may be formed into the ring state, as shown in FIG. 12.

[Application Example to Mobile Phone]

Next, a description will be given of such an example that the speaker device 100 according to the first embodiment of the present invention is applied to a receiver part and a call-indicating part of the mobile phone. In the present invention, the speaker devices 200 to 700 according to the above second to seventh embodiments are applicable to the receiver part and the call-indicating part of the mobile phone.

Figure 13:
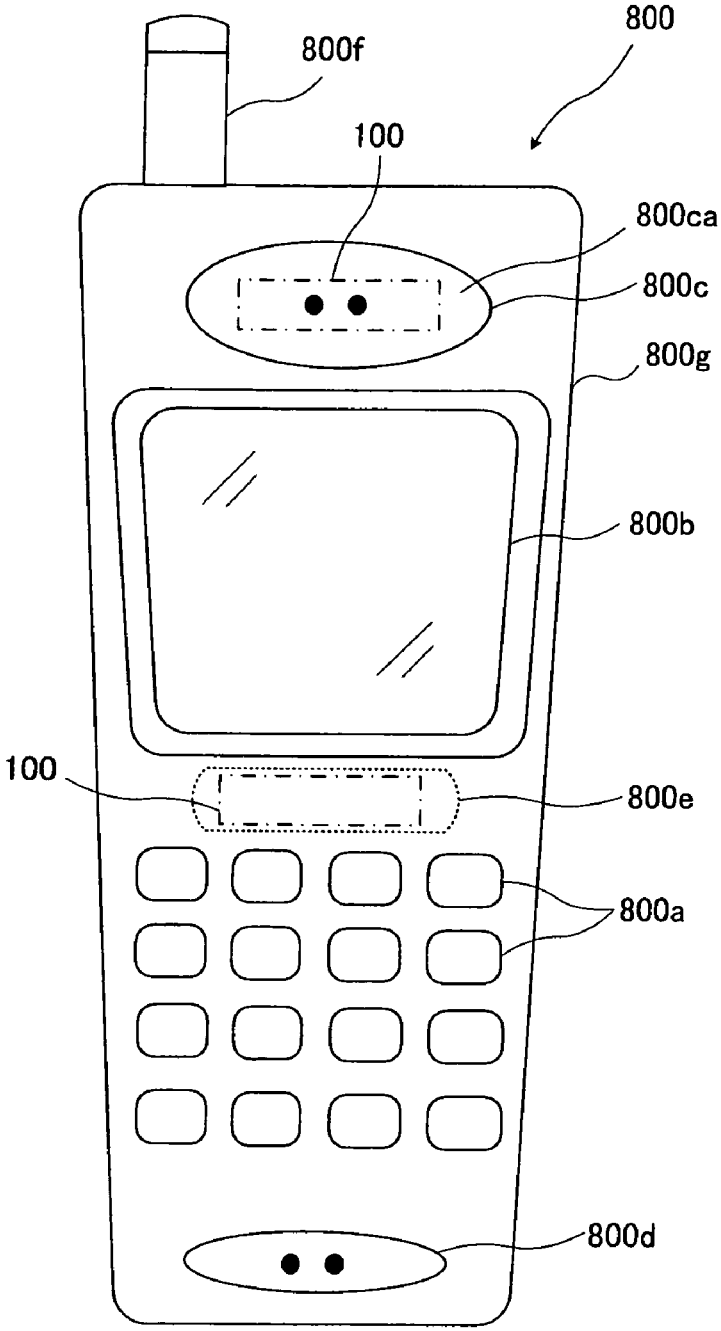
FIG. 13 is a plane view of a mobile phone using the speaker device of the present invention.

FIG. 13 is a schematic plane view showing a configuration of the mobile phone. A mobile phone 800 shown in the drawing includes plural control bottoms 800*a*, a display part 800*b*, an ear piece 800*c*, a mouth piece 800*d*, all of which are provided on a front side of a case 800*g*, a call-indicating part 800*e* provided on a back side of the case 800*g* and having a function to make a call-receiving alarm sound, and a transmitting and receiving antenna 800*f* provided on one side surface of the case 800*g*. A receiver part 800*ca* is provided in the case 800*g* corresponding to the position of the ear piece 800*c*. In the mobile phone 800 having the above configuration, the speaker device 100 which is capable of obtaining the high sensitivity and the low frequency sound output and is able to become thin and slim is loaded on the case 800*g* to be provided at positions corresponding to the receiver part 800*ca* and the call-indicating part 800*e*, for example.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2005-368531 filed on Dec. 21, 2005 including the specification, claims, drawings and summary is incorporated herein by reference in its entirety.

What is claimed is:

1. A speaker device comprising:

a magnetic circuit which includes two magnetic gaps;

a frame which houses the magnetic circuit; and a diaphragm, wherein the diaphragm includes a recessed part in which a voice coil is disposed so that respective portions of the voice coil are arranged in the two magnetic gaps, wherein a sectional shape of the recessed part that extends in parallel with the magnetic gaps is open at a side of the diaphragm, wherein the recessed part includes a pair of voice coil supporting parts for supporting the voice coil, and wherein the diaphragm includes a sound output part of a substantially semicircular sectional shape, on both sides of the recessed part, respectively, each sound output part having a first end which is connected to an upper end of a corresponding voice coil supporting part and a second end directly connected to the frame.

2. A speaker device according to claim 1, wherein the recessed part is arranged at a position passing through at least the two magnetic gaps and extends in a direction substantially orthogonal with respect to an extending direction of a magnetic flux in the magnetic gaps; and wherein the voice coil includes a first parallel part extending in one direction and a second parallel part extending in a direction in parallel with the first parallel part and opposite to the first parallel part with a constant space, wherein the first parallel part and the second parallel part are arranged in a direction in parallel with an extending direction of the recessed part, respectively, and wherein the entire first parallel part and the entire or part of the second parallel part are arranged in the recessed part to be positioned in the two magnetic gaps, respectively.

3. The speaker device according to claim 2, wherein the voice coil is formed into an elongated circular plane shape, and wherein the second parallel part is positioned above the first parallel part.

4. The speaker device according to claim 2, wherein each of the two magnetic gaps is formed at a substantially central position of the magnetic circuit, respectively, and wherein the diaphragm is formed into an elongated circular or ellipse plane shape, and the recessed part of the diaphragm is formed into an elongated shape and a U-shaped cross-section and arranged at a substantially central position of the diaphragm.

5. The speaker device according to claim 2, wherein the first parallel part and the entire or part of the second parallel part are sandwiched and fixed by side surfaces of the recessed part.

6. The speaker device according to claim 2, wherein a direction of a sound current flowing in the first parallel part and a direction of the sound current flowing in the second parallel part are opposite directions.

7. The speaker device according to claim 2, wherein the magnetic circuit includes a yoke arranged at a substantially central position of the magnetic circuit and including an opening formed longer than a length in an extending direction of the recessed part; a pair of magnets, formed into a rectangular parallelepiped shape and oppositely mounted on an upper surface of the yoke with a constant space, the positional relation of an S-pole and an N-pole of one of the pair of the magnets being reverse to the positional relation of the S-pole and the N-pole of the other one of the pair of the magnets with respect to a vibration direction of the diaphragm; and a pair of plates having a rectangular parallelepiped or flat-plate shape and oppositely mounted on an upper surface of each of the pair of magnets, wherein the magnetic gap is formed in the opening and the other magnetic gap is formed between the pair of plates, and wherein the first parallel part is positioned in the magnetic gap, and the entire or part of the second parallel part is positioned in the other magnetic gap.

8. The speaker device according to claim 7, wherein the magnets are mounted on upper surfaces of the pair of plates, and wherein the positional relation of an S-pole and an N-pole of one of the pair of the magnets being reverse to the positional relation of the S-pole and the N-pole of the other one of the pair of the magnets with respect to a vibration direction of the diaphragm.

9. The speaker device according to claim 2, wherein the magnetic circuit includes a yoke arranged at a substantially central position of the magnetic circuit and having an opening formed longer than a length in an extending direction of the recessed part, a magnet having a rectangular parallelepiped shape and mounted on an upper surface of the yoke, a magnetic body oppositely mounted on the upper surface of the yoke with a constant space to the magnet, and a plate having a rectangular parallelepiped or flat-plate shape and mounted on an upper surface of the magnet, wherein the magnetic gap is formed in the opening, and the other magnetic gap is formed between the magnet and the magnetic body, and wherein the first parallel part is positioned in the magnetic gap, and the entire or part of the second parallel part is positioned in the other magnetic gap.

10. The speaker device according to claim 2, wherein the magnetic circuit includes a yoke arranged at a substantially central position of the magnetic circuit and having an opening formed longer than a length in an extending direction of the recessed part, a pair of magnetic bodies oppositely mounted on an upper surface of the yoke with a constant space, and a pair of magnets, the positional relation of an S-pole and an N-pole of one of the pair of the magnets being reverse to the positional relation of the S-pole and the N-pole of the other one of the pair of the magnets with respect to an extending direction of the magnetic flux, wherein the magnetic gap is formed in the opening and the other magnetic gap is formed between the pair of magnetic bodies, wherein one of the pair of magnets is mounted on a side wall of the opening to be positioned in the magnetic gap, and the other magnet is arranged oppositely to the magnet with a constant space in a vibration direction of the diaphragm and mounted on one of the pair of magnetic bodies to be positioned in the other magnetic gap, and wherein the first parallel part is positioned in the magnetic gap, and the entire or part of the second parallel part is positioned in the other magnetic gap.

11. The speaker device according to claim 2, wherein the magnetic circuit includes a yoke arranged at a substantially central position of the magnetic circuit and having an opening formed longer than a length in an extending direction of the recessed part, a pair of magnetic bodies oppositely mounted on an upper surface of the yoke with a constant space, and a magnet, wherein the magnetic gap is formed in the opening and the other magnetic gap is formed between the pair of magnetic bodies, wherein the magnet is mounted on one of the pair of magnetic bodies to be positioned in the other magnetic gap, and wherein the first parallel part is positioned in the magnetic gap, and the entire or part of the second parallel part is positioned in the other magnetic gap.

12. The speaker device according to claim 2, wherein the magnetic circuit includes a yoke arranged at a substantially central position of the magnetic circuit and having an opening formed longer than a length in an extending direction of the recessed part, a pair of plates having a rectangular parallelepiped or flat-plate shape and oppositely mounted on an upper surface of the yoke, and a pair of magnets, having a rectangular parallelepiped shape and oppositely mounted on an upper surface of each of the pair of plates with a constant space, the positional relation of an S-pole and an N-pole of one of the pair of the magnets being reverse to the positional relation of the S-pole and the N-pole of the other one of the pair of the magnets with respect to a vibration direction of the diaphragm, and an additional pair of plates having a rectangular parallelepiped or flat-plate shape and oppositely mounted on an upper surface of each of the pair of magnets, wherein the magnetic gap is formed between the pair of plates, and the other magnetic gap is formed between the additional pair of plates, and wherein the first parallel part is positioned in the magnetic gap, and the entire or part of the second parallel part is positioned in the other magnetic gap.

13. The speaker device according to claim 2, wherein the frame has a cylindrical or annular plane shape, wherein a step part in a step state is formed at an outer peripheral portion on an upper surface of the frame, wherein each sound output part has a hemisphere cross-section and has a function to output an acoustic wave, wherein the diaphragm includes a step part provided at an outer peripheral portion of each sound output part and formed into a step shape, and wherein the step part of the diaphragm becomes engaged with the step part of the frame, and the recessed part is arranged at a substantially central position of the frame.

14. The speaker device according to claim 13, wherein each sound output part has a function of an edge, and wherein a length in a lateral direction of each sound output part occupies a majority of a length in a lateral direction of the diaphragm.

15. A mobile phone comprising a speaker device including:

a magnetic circuit which includes two magnetic gaps;

a frame which houses the magnetic circuit; and a diaphragm, wherein the diaphragm includes a recessed part in which a voice coil is disposed so that respective portions of the voice coil are arranged in the two magnetic gaps, wherein a sectional shape of the recessed part that extends in parallel with the magnetic gaps is open at a side of the diaphragm, wherein the recessed part includes a pair of voice coil supporting parts for supporting the voice coil, and wherein the diaphragm includes a sound output part of a substantially semicircular sectional shape, on both sides of the recessed part, respectively, each sound output part having a first end which is connected to an upper end of a corresponding voice coil supporting part and a second end directly connected to the frame.

16. The speaker device according to claim 1, wherein each sound output part is provided with a step part, wherein the frame is provided with a step part, wherein the step part of each sound output part is connected to the step part of the frame, wherein the recessed part is connected with the frame via the second output part, and wherein an end part of the recessed part is free from the frame.

17. A speaker device comprising:

a magnetic circuit including first and second magnetic gaps;

a frame housing the magnetic circuit;

a voice coil; and a diaphragm including a recessed portion in which the voice coil is arranged such that a first portion of the voice coil is disposed in the first magnetic gap and a second portion of the voice coil is disposed in the second magnetic gap, the diaphragm further including first and second sound output parts each having a substantially semicircular cross-sectional shape, the first sound output part extending between a first wall of the recessed portion and a first wall of the frame and the second sound output part extending between a second wall of the recessed portion and a second wall of the frame opposed to the first wall of the frame.

18. The speaker device according to claim 17, wherein the first and second portions of the voice coil are parallel to each other.

19. The speaker device according to claim 17, wherein the voice coil has an elongated circular shape.

20. A mobile telephone comprising the speaker device according to claim 17.

21. The speaker device according to claim 1, wherein each sound output part is provided with a step part, wherein the frame is provided with a step part, wherein the step part of each sound output part is connected to the step part of the frame, wherein the recessed part is connected with the frame via the sound output part, and wherein an end part of the recessed part is not connected to the frame.

* * * * *